US005930754A

United States Patent [19]

Karaali et al.

[11] Patent Number: 5,930,754

[45] Date of Patent: Jul. 27, 1999

[54] METHOD, DEVICE AND ARTICLE OF MANUFACTURE FOR NEURAL-NETWORK BASED ORTHOGRAPHY-PHONETICS TRANSFORMATION

[75] Inventors: Orhan Karaali, Rolling Meadows; Corey Andrew Miller, Chicago, both of Ill.

[73] Assignee: Motorola, Inc., Schaumburg, Ill.

[21] Appl. No.: 08/874,900

[22] Filed: Jun. 13, 1997

[51] Int. Cl.[6] ..... G10L 5/06

[52] U.S. Cl. ..... 704/259; 704/258; 704/232

[58] Field of Search ..... 704/259, 258, 704/232

[56] References Cited

U.S. PATENT DOCUMENTS

| | | | |
|---|---|---|---|
| 4,829,580 | 5/1989 | Church . | |
| 5,040,218 | 8/1991 | Vitale et al. . | |
| 5,668,926 | 9/1997 | Karaali et al. | 704/259 |
| 5,687,286 | 11/1997 | Bar-Yam | 704/259 |

OTHER PUBLICATIONS

"The Structure and Format of the DARPA TIMIT CD–ROM Prototype", John S. Garofolo, National Institute of Standards and Technology.

"Parallel Networks that Learn to Pronounce English Text" Terrence J. Sejnowski and Charles R. Rosenberg, Complex Systems 1, 1987, pp. 145–168.

*Primary Examiner*—David R. Hudspeth
*Assistant Examiner*—Daniel Abebe
*Attorney, Agent, or Firm*—Darleen J. Stockley

[57] ABSTRACT

A method (2000), device (2200) and article of manufacture (2300) provide, in response to orthographic information, efficient generation of a phonetic representation. The method provides for, in response to orthographic information, efficient generation of a phonetic representation, using the steps of: inputting an orthography of a word and a predetermined set of input letter features; utilizing a neural network that has been trained using automatic letter phone alignment and predetermined letter features to provide a neural network hypothesis of a word pronunciation.

61 Claims, 14 Drawing Sheets

-PRIOR ART-

| LOCATION | 1 | 2 | 3 | 4 | 5 | 6 |
|---|---|---|---|---|---|---|
| LETTER | s | c | h | o | o | 1 |
| PHONE | s | k | + | uw | + | 1 |

500

5

| LOCATION | 1 602 | 2 | 3 | 4 | 5 | 6 | 7 | 8 | 9 | 10 | 11 |
|---|---|---|---|---|---|---|---|---|---|---|---|
| SEQUENCE 1 | i | n | d | u | s | t | + | r | + | y | + |
| SEQUENCE 2 | i | n | + | + | + | t | e | r | e | s | t |

600

-PRIOR ART-

ORTHOGRAPHY

| LOCATION NUMBER | LETTER |
|---|---|
| 1 | c 702 |
| 2 | o 704 |
| 3 | a 706 |
| 4 | t 708 |

LETTER FEATURES FOR c
710

| | | | | |
|---|---|---|---|---|
| +OBSTRUENT | +CONTINUANT | +ALVEOLAR | +VELAR | +ASPIRATED |

LETTER FEATURES FOR o
712

| | | | | |
|---|---|---|---|---|
| +VOCALIC | +VOWEL | +SONORANT | +CONTINUANT | +BACK1 |
| +BACK2 | +LOW1 | +LOW2 | +VOICED | +LONG |
| +MID-LOW2 | +ROUND1 | +ROUND2 | +MID-HIGH1 | +MID-HIGH2 |

LETTER FEATURES FOR a
714

| | | | | |
|---|---|---|---|---|
| +VOCALIC | +VOWEL | +SONORANT | +CONTINUANT | +FRONT1 |
| +FRONT2 | +LOW1 | +LOW2 | +VOICED | +LONG |
| +MID1 | +MID2 | +MID-LOW1 | +LOW2 | +VOICED |
| +BACK1 | +BACK2 | | | |

LETTER FEATURES FOR t
716

| | | | | |
|---|---|---|---|---|
| +OBSTRUENT | +ALVEOLAR | +ASPIRATED | +CONTINUANT | +DENTAL |
| +VOICED | | | | |

STREAM
718

| | | | | | | | | | |
|---|---|---|---|---|---|---|---|---|---|
| 4 | 6 | 32 | 36 | 41 | 101 | 102 | 103 | 106 | 119 |
| 120 | 127 | 128 | 150 | 153 | 126 | 151 | 152 | 123 | 124 |
| 201 | 202 | 203 | 206 | 213 | 214 | 227 | 228 | 250 | 253 |
| 217 | 218 | 225 | 228 | 250 | 219 | 220 | 304 | 332 | 341 |
| 306 | 331 | 350 | | | | | | | |

700

*FIG. 7*

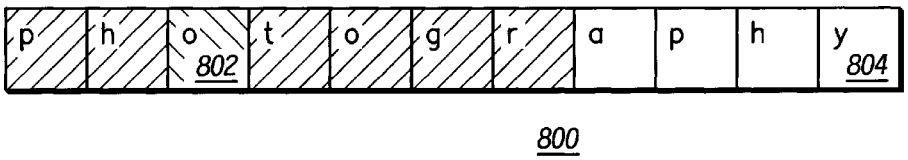
FIG.8
-PRIOR ART-
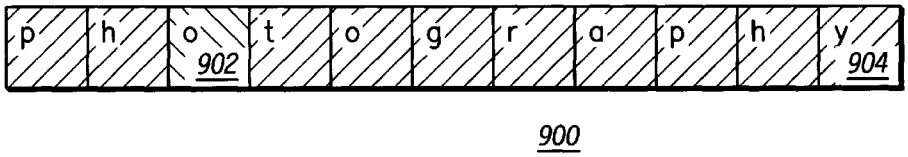
FIG.9
TARGET
1002
| | | | | |
|---|---|---|---|---|
| r | ae | p | ih | d |
HYPOTHESES
| | EUCLIDEAN | FEATURE-BASED | | | | | |
|---|---|---|---|---|---|---|---|
| 1004 | 2 | 1.21 | r | ae | p | ax | d |
| 1006 | 2 | 2 | r | ae | p | b | d |
1000
FIG.10

| PHONE | ih | ax |
|---|---|---|
| TARGET ($d_k$) | 1 | 0 |
| HYPOTHESIS ($o_k$) | 0 | 1 |
| LOCAL ERROR ($d_k-o_k$) | 1 | −1 |
| $(d_k-o_k)^2$ | 1 | 1 |

$$\sum_k((d_k-o_k)^2)=2$$

1100

FIG.11
-PRIOR ART-

| PHONE | ih | ax |
|---|---|---|
| TARGET ($d_k$) | 1 | 0 |
| HYPOTHESIS ($o_k$) | 0 | 1 |
| LOCAL ERROR $M*(d_k-o_k)$ | 1(M=1) | −.1(M=.1) |
| $(M*(d_k-o_k))^2$ | 1 | .21 |

$$\sum_k((d_k-o_k)^2)=1.21$$

1200

FIG.12

FIG.20 2000 12/14
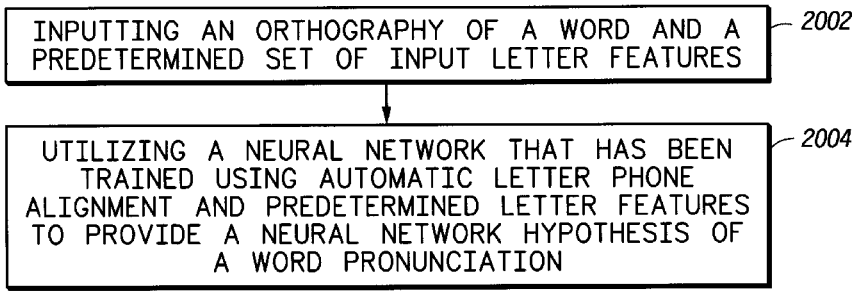
FIG.21 2100
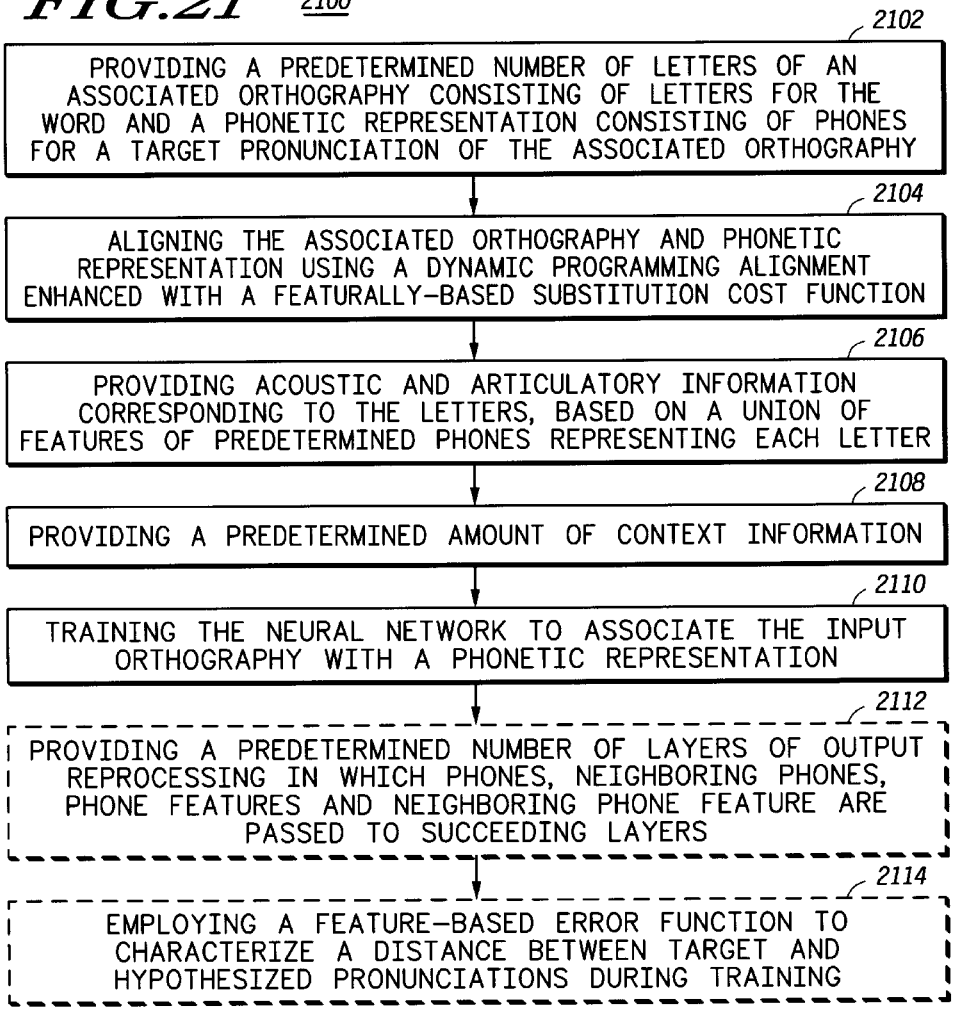

METHOD, DEVICE AND ARTICLE OF MANUFACTURE FOR NEURAL-NETWORK BASED ORTHOGRAPHY-PHONETICS TRANSFORMATION

FIELD OF THE INVENTION

The present invention relates to the generation of phonetic forms from orthography, with particular application in the field of speech synthesis.

BACKGROUND OF THE INVENTION

As shown in FIG. 1, numeral 100, text-to-speech synthesis is the conversion of written or printed text (102) into speech (110). Text-to-speech synthesis offers the possibility of providing voice output at a much lower cost than recording speech and playing that speech back. Speech synthesis is often employed in situations where the text is likely to vary a great deal and where it is simply not possible to record the text beforehand.

Speech synthesizers need to convert text (102) to a phonetic representation (106) that is then passed to an acoustic module (108) which converts the phonetic representation to a speech waveform (110).

In a language like English, where the pronunciation of words is often not obvious from the orthography of words, it is important to convert orthographies (102) into unambiguous phonetic representations (106) by means of a linguistic module (104) which are then submitted to an acoustic module (108) for the generation of speech waveforms (110). In order to produce the most accurate phonetic representations, a pronunciation lexicon is required. However, it is simply not possible to anticipate all possible words that a synthesizer may be required to pronounce. For example, many names of people and businesses, as well as neologisms and novel blends and compounds are created every day. Even if it were possible to enumerate all such words, the storage requirements would exceed the feasibility of most applications.

In order to pronounce words that are not found in pronunciation dictionaries, prior researchers have employed letter-to-sound rules, more or less of the form—orthographic c becomes phonetic /s/ before orthographic e and i, and phonetic /k/ elsewhere. As is customary in the art, pronunciations will be enclosed in slashes: //. For a language like English, several hundred such rules associated with a strict ordering are required for reasonable accuracy. Such a rule-set is extremely labor-intensive to create and difficult to debug and maintain, in addition to the fact that such a rule-set cannot be used for a language other than the one for which the rule-set was created.

Another solution that has been put forward has been a neural network that is trained on an existing pronunciation lexicon and that learns to generalize from the lexicon in order to pronounce novel words. Previous neural network approaches have suffered from the requirement that letter-phone correspondences in the training data be aligned by hand. In addition, such prior neural networks failed to associate letters with the phonetic features of which the letters might be composed. Finally, evaluation metrics were based solely on insertions, substitutions and deletions, without regard to the featural composition of the phones involved.

Therefore, there is a need for an automatic procedure for learning to generate phonetics from orthography that does not require rule-sets or hand alignment, that takes advantage of the phonetic featural content of orthography, and that is evaluated, and whose error is backpropagated, on the basis of the featural content of the generated phones. A method, device and article of manufacture for neural-network based orthography-phonetics transformation is needed.

BRIEF DESCRIPTION OF THE DRAWINGS

FIG. 7 is a schematic representation of the neural network encoding of letter features for the orthography coat in accordance with the present invention.

FIG. 8 is a schematic representation of a seven-letter window for neural network input as is known in the art.

FIG. 9 is a schematic representation of a whole-word storage buffer for neural network input in accordance with the present invention.

FIG. 10 presents a comparison of the Euclidean error measure with one embodiment of the feature-based error measure in accordance with the present invention for calculating the error distance between the target pronunciation /raepihd/ and each of the two possible neural network hypotheses: /raepaxd/ and /raepbd/.

FIG. 11 illustrates the calculation of the Euclidean distance measure as is known in the art for calculating the error distance between the target pronunciation /raepihd/ and the neural network hypothesis pronunciation /raepaxd/.

FIG. 12 illustrates the calculation of the feature-based distance measure in accordance with the present invention for calculating the error distance between the target pronunciation /raepihd/ and the neural network hypothesis pronunciation /raepaxd/.

FIG. 20 is a flowchart of one embodiment of steps for inputting orthographies and letter features and utilizing a neural network to hypothesize a pronunciation in accordance with the present invention.

FIG. 21 is a flowchart of one embodiment of steps for training a neural network to transform orthographies into pronunciations in accordance with the present invention.

DETAILED DESCRIPTION OF A PREFERRED EMBODIMENT

Figure 1:
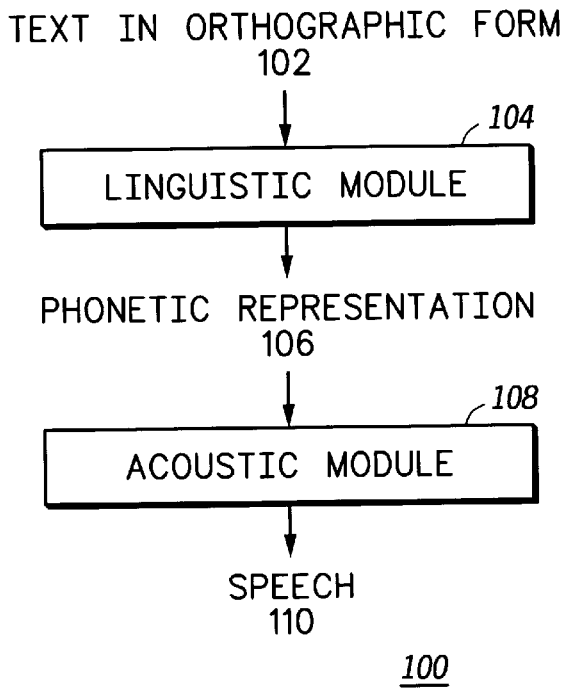
FIG. 1 is a schematic representation of the transformation of text to speech as is known in the art.
Figure 2:
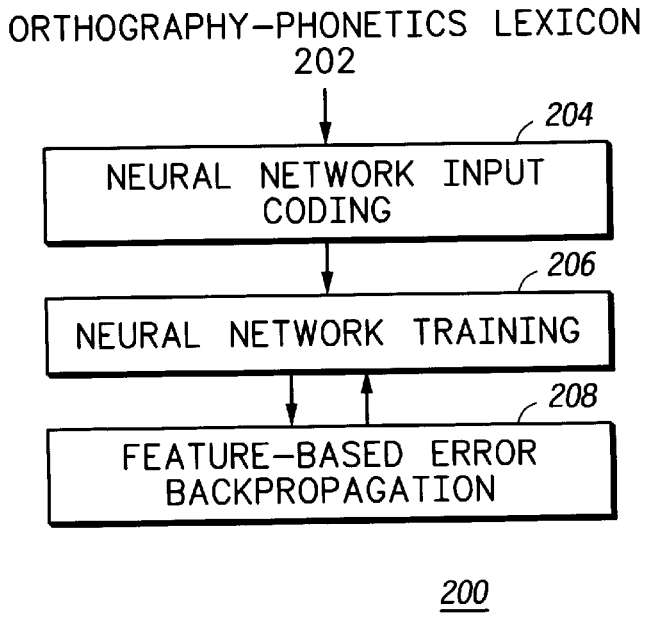
FIG. 2 is a schematic representation of one embodiment of the neural network training process used in the training of the orthography-phonetics converter in accordance with the present invention.

The present invention provides a method and device for automatically converting orthographies into phonetic representations by means of a neural network trained on a lexicon consisting of orthographies paired with corresponding phonetic representations. The training results in a neural network with weights that represent the transfer function required to produce phonetics from orthography. FIG. 2, numeral 200, provides a high-level view of the neural network training process, including the orthography-phonetics lexicon (202), the neural network input coding (204), the neural network training (206) and the feature-based error backpropagation (208). The method, device and article of manufacture for neural-network based orthography-phonetics transformation of the present invention offers a financial advantage over the prior art in that the system is automatically trainable and can be adapted to any language with ease.

Figure 3:
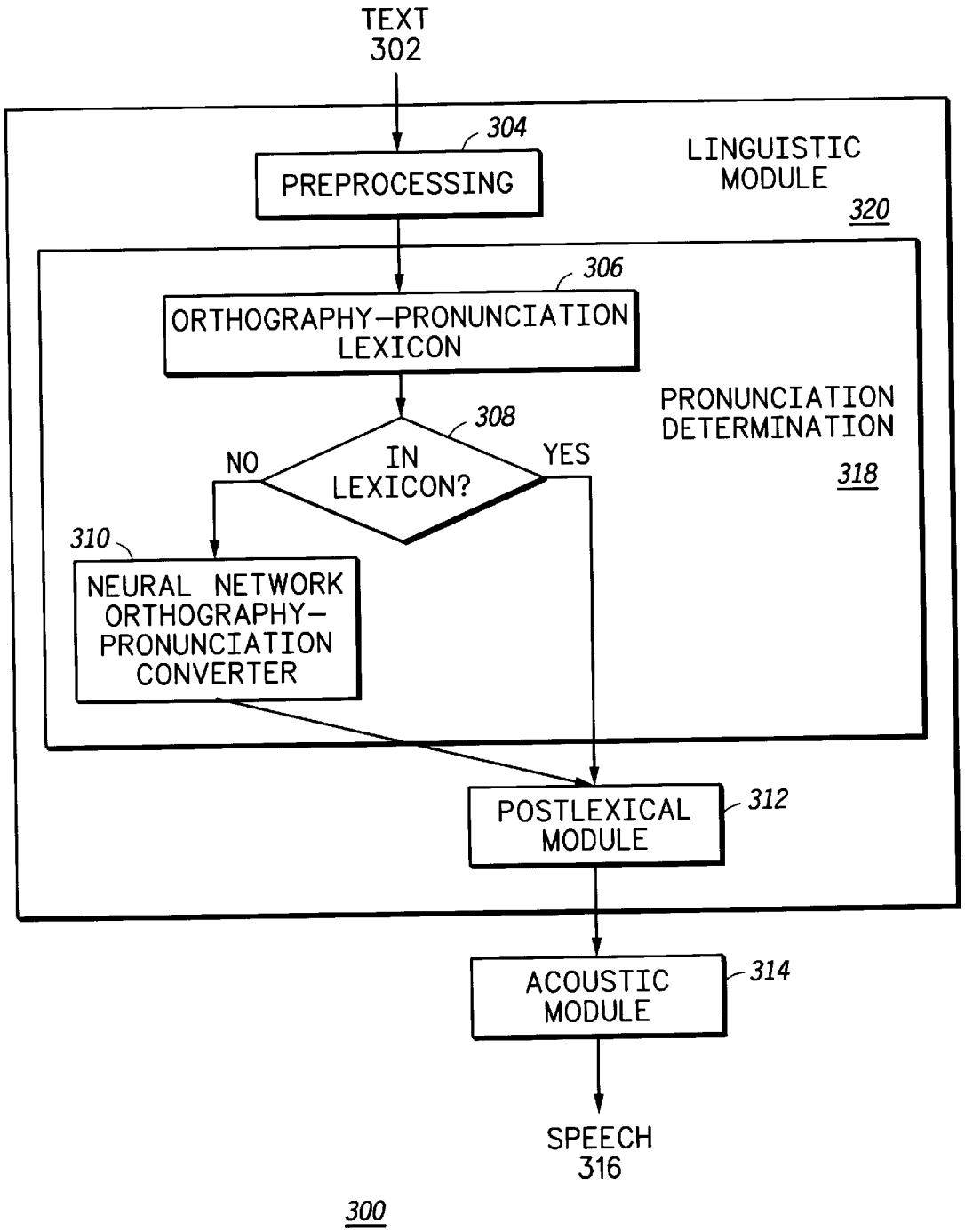
FIG. 3 is a schematic representation of one embodiment of the transformation of text to speech employing the neural network orthography-phonetics converter in accordance with the present invention.

FIG. 3, numeral 300, shows where the trained neural network orthography-phonetics converter, numeral 310, fits into the linguistic module of a speech synthesizer (320) in one preferred embodiment of the present invention, including text (302); preprocessing (304); a pronunciation determination module (318) consisting of an orthography-phonetics lexicon (306), a lexicon presence decision unit (308), and a neural network orthography-phonetics converter (310); a postlexical module (312), and an acoustic module (314) which generates speech (316).

In order to train a neural network to learn orthography-phonetics mapping, an orthography-phonetics lexicon (202) is obtained. Table 1 displays an excerpt from an orthography-phonetics lexicon.

TABLE 1

| Orthography | Pronunciation |
|---|---|
| cat | kaet |
| dog | daog |
| school | skuwl |
| coat | kowt |

The lexicon stores pairs of orthographies with associated pronunciations. In this embodiment, orthographies are represented using the letters of the English alphabet, shown in Table 2.

TABLE 2

| Number | Letter | Number | Letter |
|---|---|---|---|
| 1 | a | 14 | n |
| 2 | b | 15 | o |
| 3 | c | 16 | p |
| 4 | d | 17 | q |
| 5 | e | 18 | r |
| 6 | f | 19 | s |
| 7 | g | 20 | t |
| 8 | h | 21 | u |
| 9 | i | 22 | v |
| 10 | j | 23 | w |
| 11 | k | 24 | x |
| 12 | l | 25 | y |
| 13 | m | 26 | z |

In this embodiment, the pronunciations are described using a subset of the TIMIT phones from Garofolo, John S., "The Structure and Format of the DARPA TIMIT CD-ROM Prototype", National Institute of Standards and Technology, 1988. The phones are shown in Table 3, along with representative orthographic words illustrating the phones' sounds. The letters in the orthographies that account for the particular TIMIT phones are shown in bold.

TABLE 3

| Number | TIMIT phone | sample word | Number | TIMIT phone | sample word |
|---|---|---|---|---|---|
| 1 | p | **p**op | 21 | aa | **f**ather |
| 2 | t | **t**ot | 22 | uw | l**oo**p |
| 3 | k | **k**i**ck** | 23 | er | b**ir**d |
| 4 | m | **m**om | 24 | ay | h**igh** |
| 5 | n | **n**o**n** | 25 | ey | b**ay** |
| 6 | ng | si**ng** | 26 | aw | **ou**t |
| 7 | s | **s**et | 27 | ax | sof**a** |
| 8 | z | **z**oo | 28 | b | **b**arn |
| 9 | ch | **ch**op | 29 | d | **d**og |
| 10 | th | **th**in | 30 | g | **g**o |
| 11 | f | **f**ord | 31 | sh | **sh**oe |
| 12 | l | **l**ong | 32 | zh | gara**ge** |
| 13 | r | **r**ed | 33 | dh | **th**is |
| 14 | y | **y**oung | 34 | v | **v**ice |
| 15 | hh | **h**eavy | 35 | w | **w**alk |
| 16 | eh | b**e**d | 36 | ih | gi**f**t |
| 17 | ao | s**aw** | 37 | ae | **fa**st |
| 18 | ah | r**u**st | 38 | uh | b**oo**k |
| 19 | oy | b**oy** | 39 | iy | b**ee** |
| 20 | ow | l**ow** | | | |

In order for the neural network to be trained on the lexicon, the lexicon must be coded in a particular way that maximizes learnability; this is the neural network input coding in numeral (204).

The input coding for training consists of the following components: alignment of letters and phones, extraction of letter features, converting the input from letters and phones to numbers, loading the input into the storage buffer, and training using feature-driven error backpropagation. The input coding for training requires the generation of three streams of input to the neural network simulator. Stream 1 contains the phones of the pronunciation interspersed with any alignment separators, Stream 2 contains the letters of the orthography, and Stream 3 contains the features associated with each letter of the orthography.

Figures 4, 5, 6:
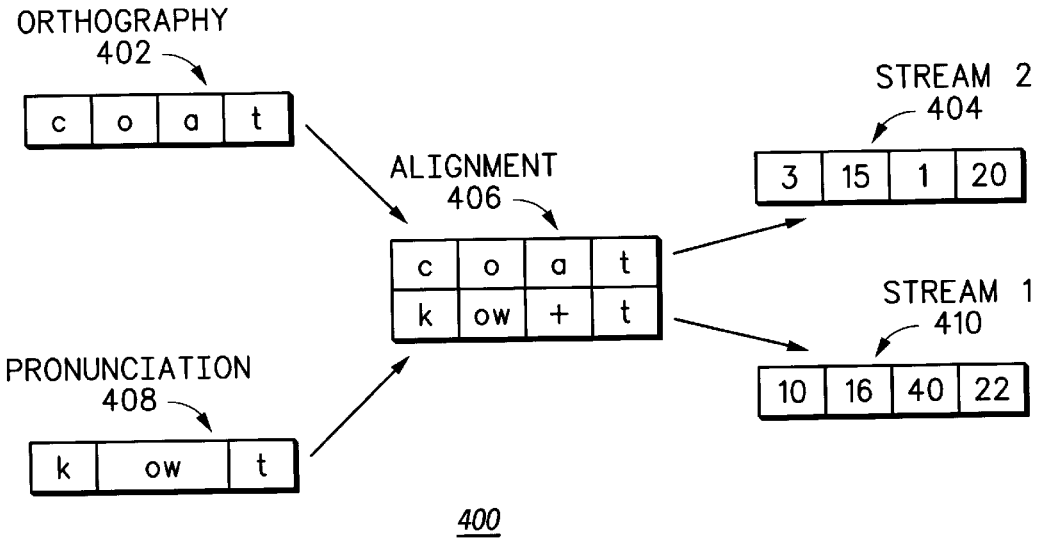
FIG. 4 is a schematic representation of the alignment and neural network encoding of the orthography coat with the phonetic representation /kowt/ in accordance with the present invention.
FIG. 5 is a schematic representation of the one letter-one phoneme alignment of the orthography school and the pronunciation /skuwl/ in accordance with the present invention.
FIG. 6 is a schematic representation of the alignment of the orthography industry with the orthography interest, as is known in the art.

FIG. 4, numeral 400, illustrates the alignment (406) of an orthography (402) and a phonetic representation (408), the encoding of the orthography as Stream 2 (404) of the neural network input encoding for training, and the encoding of the phonetic representation as Stream 1 (410) of the neural network input encoding for training. An input orthography, coat (402), and an input pronunciation from a pronunciation lexicon, /kowt/ (408), are submitted to an alignment procedure (406).

Alignment of letters and phones is necessary to provide the neural network with a reasonable sense of which letters correspond to which phones. In fact, accuracy results more than doubled when aligned pairs of orthographies and pronunciations were used compared to unaligned pairs. Alignment of letters and phones means to explicitly associate particular letters with particular phones in a series of locations.

FIG. 5, numeral 500, illustrates an alignment of the orthography school with the pronunciation /skuwl/ with the constraint that only one phone and only one letter is permitted per location. The alignment in FIG. 5, which will be referred to as "one phone-one letter" alignment, is performed for neural network training. In one phone-one letter alignment, when multiple letters correspond to a single phone, as in orthographic ch corresponding to phonetic /k/, as in school, the single phone is associated with the first letter in the cluster, and alignment separators, here "+", are inserted in the subsequent locations associated with the subsequent letters in the cluster.

In contrast to some prior neural network approaches to neural network orthography-phonetics conversion which achieved orthography-phonetic alignments painstakingly by hand, a new variation to the dynamic programming algorithm that is known in the art was employed. The version of dynamic programming known in the art has been described with respect to aligning words that use the same alphabet, such as the English orthographies industry and interest, as shown in FIG. 6, numeral 600. Costs are applied for insertion, deletion and substitution of characters. Substitutions have no cost only when the same character is in the same location in each sequence, such as the i in location 1, numeral 602.

In order to align sequences from different alphabets, such as orthographies and pronunciations, where the alphabet for orthographies was shown in Table 2, and the alphabet for pronunciations was shown in Table 3, a new method was devised for calculating substitution costs. A customized table reflecting the particularities of the language for which an orthography-phonetics converter is being developed was designed. Table 4 below illustrates the letter-phone cost table for English.

TABLE 4

| Letter | Phone | Cost | Letter | Phone | Cost |
|---|---|---|---|---|---|
| l | l | 0 | q | k | 0 |
| l | el | 0 | s | s | 0 |

TABLE 4-continued

| Letter | Phone | Cost | Letter | Phone | Cost |
|---|---|---|---|---|---|
| r | r | 0 | s | z | 0 |
| r | er | 0 | h | hh | 0 |
| r | axr | 0 | a | ae | 0 |
| y | y | 0 | a | ey | 0 |
| y | iy | 0 | a | ax | 0 |
| y | ih | 0 | a | aa | 0 |
| w | w | 0 | e | eh | 0 |
| m | m | 0 | e | iy | 0 |
| n | n | 0 | e | ey | 0 |
| n | en | 0 | e | ih | 0 |
| b | b | 0 | e | ax | 0 |
| c | k | 0 | i | ih | 0 |
| c | s | 0 | i | ay | 0 |
| d | d | 0 | i | iy | 0 |
| d | t | 0 | o | aa | 0 |
| g | g | 0 | o | ao | 0 |
| g | zh | 1 | o | ow | 0 |
| j | zh | 1 | o | oy | 0 |
| j | jh | 0 | o | aw | 0 |
| p | p | 0 | o | uw | 0 |
| t | t | 0 | o | ax | 0 |
| t | ch | 1 | u | uh | 0 |
| k | k | 0 | u | ah | 0 |
| z | z | 0 | u | uw | 0 |
| v | v | 0 | u | ax | 0 |
| f | f | 0 | g | f | 2 |

For substitutions other than those covered in the table in Table 4, and insertions and deletions, the costs used in the art of speech recognition scoring are employed: insertion costs 3, deletion costs 3 and substitution costs 4. With respect to Table 4, in some cases, the cost for allowing a particular correspondence should be less than the fixed cost for insertion or deletion, in other cases greater. The more likely it is that a given phone and letter could correspond in a particular position, the lower the cost for substituting that phone and letter.

When the orthography coat (402) and the pronunciation /kowt/ (408) are aligned, the alignment procedure (406) inserts an alignment separator, '+', into the pronunciation, making /kow+t/. The pronunciation with alignment separators is converted to numbers by consulting Table 3 and loaded into a word-sized storage buffer for Stream 1 (410). The orthography is converted to numbers by consulting Table 2 and loaded into a word-sized storage buffer for Stream 2 (404).

FIG. 7, numeral 700, illustrates the coding of Stream 3 of the neural network input encoding for training. Each letter of the orthography is associated with its letter features.

In order to give the neural network further information upon which to generalize beyond the training set, a novel concept, that of letter features, was provided in the input coding. Acoustic and articulatory features for phonological segments are a common concept in the art. That is, each phone can be described by several phonetic features. Table 5 shows the features associated with each phone that appears in the pronunciation lexicon in this embodiment. For each phone, a feature can either be activated '+', not activated, '−', or unspecified '0'.

TABLE 5

| Phoneme | Phoneme Number | Vocalic | Vowel | Sonorant | Obstruent | Flap | Continuant | Affricate | Nasal | Approximant | Click | Trill | Silence |
|---|---|---|---|---|---|---|---|---|---|---|---|---|---|
| ax | 1 | + | + | + | − | − | + | − | − | − | − | − | − |
| axr | 2 | + | + | + | − | − | + | − | − | − | − | − | − |
| er | 3 | + | + | + | − | − | + | − | − | − | − | − | − |
| r | 4 | − | − | + | − | − | + | − | − | + | − | − | − |
| ao | 5 | + | + | + | − | − | + | − | − | − | − | − | − |
| ae | 6 | + | + | + | − | − | + | − | − | − | − | − | − |
| aa | 7 | + | + | + | − | − | + | − | − | − | − | − | − |
| dh | 8 | − | − | − | + | − | + | − | − | − | − | − | − |
| eh | 9 | + | + | + | − | − | + | − | − | − | − | − | − |
| ih | 10 | + | + | + | − | − | + | − | − | − | − | − | − |
| ng | 11 | − | − | + | + | − | − | − | + | − | − | − | − |
| sh | 12 | − | − | − | + | − | + | − | − | − | − | − | − |
| th | 13 | − | − | − | + | − | + | − | − | − | − | − | − |
| uh | 14 | + | + | + | − | − | + | − | − | − | − | − | − |
| zh | 15 | − | − | − | + | − | + | − | − | − | − | − | − |
| ah | 16 | + | + | + | − | − | + | − | − | − | − | − | − |
| ay | 17 | + | + | + | − | − | + | − | − | − | − | − | − |
| aw | 18 | + | + | + | − | − | + | − | − | − | − | − | − |
| b | 19 | − | − | − | + | − | − | − | − | − | − | − | − |
| dx | 20 | − | − | − | + | + | − | − | − | − | − | − | − |
| d | 21 | − | − | − | + | − | − | − | − | − | − | − | − |
| jh | 22 | − | − | − | + | − | + | + | − | − | − | − | − |
| ey | 23 | + | + | + | − | − | + | − | − | − | − | − | − |
| f | 24 | − | − | − | + | − | + | − | − | − | − | − | − |
| g | 25 | − | − | − | + | − | − | − | − | − | − | − | − |
| hh | 26 | − | − | − | + | − | + | − | − | − | − | − | − |
| iy | 27 | + | + | + | − | − | + | − | − | − | − | − | − |
| y | 28 | + | − | + | − | − | + | − | − | + | − | − | − |
| k | 29 | − | − | − | + | − | − | − | − | − | − | − | − |
| l | 30 | − | − | + | − | − | + | − | − | + | − | − | − |
| el | 31 | + | − | + | − | − | + | − | − | − | − | − | − |
| m | 32 | − | − | + | + | − | − | − | + | − | − | − | − |
| n | 33 | − | − | + | + | − | − | − | + | − | − | − | − |
| en | 34 | + | − | + | + | − | − | − | + | − | − | − | − |
| ow | 35 | + | + | + | − | − | + | − | − | − | − | − | − |
| ov | 36 | + | + | + | − | − | + | − | − | − | − | − | − |
| p | 37 | − | − | − | + | − | − | − | − | − | − | − | − |
| s | 38 | − | − | − | + | − | + | − | − | − | − | − | − |
| t | 39 | − | − | − | + | − | − | − | − | − | − | − | − |
| ch | 40 | − | − | − | + | − | + | + | − | − | − | − | − |
| uw | 41 | + | + | + | − | − | + | − | − | − | − | − | − |
| v | 42 | − | − | − | + | − | + | − | − | − | − | − | − |
| w | 43 | + | − | + | − | − | + | − | − | + | − | − | − |
| z | 44 | − | − | − | + | − | + | − | − | − | − | − | − |

| Phoneme | Front 1 | Front 2 | Mid front 1 | Mid front 2 | Mid 1 | Mid 2 | Back 1 | Back 2 | High 1 | High 2 | Mid high 1 | Mid high 2 | Mid low 1 | Mid low 2 |
|---|---|---|---|---|---|---|---|---|---|---|---|---|---|---|
| ax | − | − | − | − | + | + | − | − | − | − | − | − | + | + |
| axr | − | − | − | − | + | + | − | − | − | − | − | − | + | + |
| er | − | − | − | − | + | + | − | − | − | − | − | − | + | + |
| r | 0 | 0 | 0 | 0 | 0 | 0 | 0 | 0 | 0 | 0 | 0 | 0 | 0 | 0 |
| ao | − | − | − | − | − | − | + | + | − | − | − | − | + | + |
| ae | + | + | − | − | − | − | − | − | − | − | − | − | − | − |
| aa | − | − | − | − | − | − | + | + | − | − | − | − | − | − |
| dh | 0 | 0 | 0 | 0 | 0 | 0 | 0 | 0 | 0 | 0 | 0 | 0 | 0 | 0 |
| eh | + | + | − | − | − | − | − | − | − | − | − | − | + | + |
| ih | − | − | + | + | − | − | − | − | − | − | + | + | − | − |
| ng | 0 | 0 | 0 | 0 | 0 | 0 | 0 | 0 | 0 | 0 | 0 | 0 | 0 | 0 |
| sh | 0 | 0 | 0 | 0 | 0 | 0 | 0 | 0 | 0 | 0 | 0 | 0 | 0 | 0 |
| th | 0 | 0 | 0 | 0 | 0 | 0 | 0 | 0 | 0 | 0 | 0 | 0 | 0 | 0 |
| uh | − | − | − | − | − | − | + | + | − | − | + | + | − | − |
| zh | 0 | 0 | 0 | 0 | 0 | 0 | 0 | 0 | 0 | 0 | 0 | 0 | 0 | 0 |
| ah | − | − | − | − | − | − | + | + | − | − | − | − | + | + |
| ay | + | − | − | + | − | − | − | − | − | − | − | + | − | − |
| aw | + | − | − | − | − | − | − | + | − | − | − | + | − | − |
| b | 0 | 0 | 0 | 0 | 0 | 0 | 0 | 0 | 0 | 0 | 0 | 0 | 0 | 0 |
| dx | 0 | 0 | 0 | 0 | 0 | 0 | 0 | 0 | 0 | 0 | 0 | 0 | 0 | 0 |
| d | 0 | 0 | 0 | 0 | 0 | 0 | 0 | 0 | 0 | 0 | 0 | 0 | 0 | 0 |
| jh | 0 | 0 | 0 | 0 | 0 | 0 | 0 | 0 | 0 | 0 | 0 | 0 | 0 | 0 |
| ey | + | + | − | − | − | − | − | − | − | + | + | − | − | − |
| f | 0 | 0 | 0 | 0 | 0 | 0 | 0 | 0 | 0 | 0 | 0 | 0 | 0 | 0 |
| g | 0 | 0 | 0 | 0 | 0 | 0 | 0 | 0 | 0 | 0 | 0 | 0 | 0 | 0 |
| hh | 0 | 0 | 0 | 0 | 0 | 0 | 0 | 0 | 0 | 0 | 0 | 0 | 0 | 0 |
| iy | + | + | − | − | − | − | − | − | + | + | − | − | − | − |
| y | 0 | 0 | 0 | 0 | 0 | 0 | 0 | 0 | 0 | 0 | 0 | 0 | 0 | 0 |

TABLE 5-continued

| | | | | | | | | | | | | | | |
|---|---|---|---|---|---|---|---|---|---|---|---|---|---|---|
| k | 0 | 0 | 0 | 0 | 0 | 0 | 0 | 0 | 0 | 0 | 0 | 0 | 0 | 0 |
| l | 0 | 0 | 0 | 0 | 0 | 0 | 0 | 0 | 0 | 0 | 0 | 0 | 0 | 0 |
| el | 0 | 0 | 0 | 0 | 0 | 0 | 0 | 0 | 0 | 0 | 0 | 0 | 0 | 0 |
| m | 0 | 0 | 0 | 0 | 0 | 0 | 0 | 0 | 0 | 0 | 0 | 0 | 0 | 0 |
| n | 0 | 0 | 0 | 0 | 0 | 0 | 0 | 0 | 0 | 0 | 0 | 0 | 0 | 0 |
| en | 0 | 0 | 0 | 0 | 0 | 0 | 0 | 0 | 0 | 0 | 0 | 0 | 0 | 0 |
| ow | − | − | − | − | − | − | + | + | − | − | + | + | − | − |
| ov | − | + | − | − | − | − | + | − | − | + | + | − | − | − |
| p | 0 | 0 | 0 | 0 | 0 | 0 | 0 | 0 | 0 | 0 | 0 | 0 | 0 | 0 |
| s | 0 | 0 | 0 | 0 | 0 | 0 | 0 | 0 | 0 | 0 | 0 | 0 | 0 | 0 |
| t | 0 | 0 | 0 | 0 | 0 | 0 | 0 | 0 | 0 | 0 | 0 | 0 | 0 | 0 |
| ch | 0 | 0 | 0 | 0 | 0 | 0 | 0 | 0 | 0 | 0 | 0 | 0 | 0 | 0 |
| uw | − | − | − | − | − | − | + | + | + | + | − | − | − | − |
| v | 0 | 0 | 0 | 0 | 0 | 0 | 0 | 0 | 0 | 0 | 0 | 0 | 0 | 0 |
| w | 0 | 0 | 0 | 0 | 0 | 0 | 0 | 0 | 0 | 0 | 0 | 0 | 0 | 0 |
| z | 0 | 0 | 0 | 0 | 0 | 0 | 0 | 0 | 0 | 0 | 0 | 0 | 0 | 0 |

| Phoneme | Low 1 | Low 2 | Bilabial | Labiodental | Dental | Alveolar | Post-alveolar | Retroflex | Palatal | Velar | Uvular | Pharyngeal | Glottal |
|---|---|---|---|---|---|---|---|---|---|---|---|---|---|
| ax | − | − | 0 | 0 | 0 | 0 | 0 | − | 0 | 0 | 0 | 0 | 0 |
| axr | − | − | 0 | 0 | 0 | 0 | 0 | − | 0 | 0 | 0 | 0 | 0 |
| er | − | − | 0 | 0 | 0 | 0 | 0 | − | 0 | 0 | 0 | 0 | 0 |
| r | 0 | 0 | − | − | − | + | + | + | − | − | − | − | − |
| ao | − | − | 0 | 0 | 0 | 0 | 0 | − | 0 | 0 | 0 | 0 | 0 |
| ae | + | + | 0 | 0 | 0 | 0 | 0 | − | 0 | 0 | 0 | 0 | 0 |
| aa | + | + | 0 | 0 | 0 | 0 | 0 | − | 0 | 0 | 0 | 0 | 0 |
| dh | 0 | 0 | − | − | + | − | − | − | − | − | − | − | − |
| eh | − | − | 0 | 0 | 0 | 0 | 0 | − | 0 | 0 | 0 | 0 | 0 |
| ih | − | − | 0 | 0 | 0 | 0 | 0 | − | 0 | 0 | 0 | 0 | 0 |
| ng | 0 | 0 | − | − | − | − | − | − | − | + | − | − | − |
| sh | 0 | 0 | − | − | − | − | + | − | − | − | − | − | − |
| th | 0 | 0 | − | − | + | − | − | − | − | − | − | − | − |
| uh | − | − | 0 | 0 | 0 | 0 | 0 | − | 0 | 0 | 0 | 0 | 0 |
| zh | 0 | 0 | − | − | − | − | + | − | − | − | − | − | − |
| ah | − | − | 0 | 0 | 0 | 0 | 0 | − | 0 | 0 | 0 | 0 | 0 |
| ay | + | − | 0 | 0 | 0 | 0 | 0 | − | 0 | 0 | 0 | 0 | 0 |
| aw | + | − | 0 | 0 | 0 | 0 | 0 | − | 0 | 0 | 0 | 0 | 0 |
| b | 0 | 0 | + | − | − | − | − | − | − | − | − | − | − |
| dx | 0 | 0 | − | − | − | + | − | − | − | − | − | − | − |
| d | 0 | 0 | − | − | − | + | − | − | − | − | − | − | − |
| jh | 0 | 0 | − | − | − | − | + | − | − | − | − | − | − |
| ey | − | − | 0 | 0 | 0 | 0 | 0 | − | 0 | 0 | 0 | 0 | 0 |
| f | 0 | 0 | − | + | − | − | − | − | − | − | − | − | − |
| g | 0 | 0 | − | − | − | − | − | − | − | + | − | − | − |
| hh | 0 | 0 | − | − | − | − | − | − | − | − | − | − | + |
| iy | − | − | 0 | 0 | 0 | 0 | 0 | − | 0 | 0 | 0 | 0 | 0 |
| y | 0 | 0 | − | − | − | − | − | − | + | − | − | − | − |
| k | 0 | 0 | − | − | − | − | − | − | − | + | − | − | − |
| l | 0 | 0 | − | − | − | + | − | − | − | − | − | − | − |
| el | 0 | 0 | − | − | − | + | − | − | − | − | − | − | − |
| m | 0 | 0 | + | − | − | − | − | − | − | − | − | − | − |
| n | 0 | 0 | − | − | − | + | − | − | − | − | − | − | − |
| en | 0 | 0 | − | − | − | + | − | − | − | − | − | − | − |
| ow | − | − | 0 | 0 | 0 | 0 | 0 | − | 0 | 0 | 0 | 0 | 0 |
| ov | − | − | 0 | 0 | 0 | 0 | 0 | − | 0 | 0 | 0 | 0 | 0 |
| p | 0 | 0 | + | − | − | − | − | − | − | − | − | − | − |
| s | 0 | 0 | − | − | − | + | − | − | − | − | − | − | − |
| t | 0 | 0 | − | − | − | + | − | − | − | − | − | − | − |
| ch | 0 | 0 | − | − | − | − | + | − | − | − | − | − | − |
| uw | − | − | 0 | 0 | 0 | 0 | 0 | − | 0 | 0 | 0 | 0 | 0 |
| v | 0 | 0 | − | + | − | − | − | − | − | − | − | − | − |
| w | 0 | 0 | + | − | − | − | − | − | − | + | − | − | − |
| z | 0 | 0 | − | − | − | + | − | − | − | − | − | − | − |

| Phoneme | Epi-glottal | Aspirated | Hyper-aspirated | Closure | Ejective | Im-plosive | Lab-lialized | Lateral | Nasal-ized | Rhota-cized | Voiced | Round 1 | Round 2 | Long |
|---|---|---|---|---|---|---|---|---|---|---|---|---|---|---|
| ax | 0 | − | − | − | − | − | − | − | − | − | + | − | − | − |
| axr | 0 | − | − | − | − | − | − | − | − | + | + | − | − | − |
| er | 0 | − | − | − | − | − | − | − | − | + | + | − | − | + |
| r | − | − | − | − | − | − | − | − | − | + | + | 0 | 0 | 0 |
| ao | 0 | − | − | − | − | − | − | − | − | − | + | + | + | − |
| ae | 0 | − | − | − | − | − | − | − | − | − | + | − | − | + |
| aa | 0 | − | − | − | − | − | − | − | − | − | + | − | − | + |
| dh | − | − | − | − | − | − | − | − | − | − | + | 0 | 0 | 0 |
| eh | 0 | − | − | − | − | − | − | − | − | − | + | − | − | − |
| ih | 0 | − | − | − | − | − | − | − | − | − | + | − | − | − |
| ng | − | − | − | − | − | − | − | − | − | − | + | 0 | 0 | 0 |

TABLE 5-continued

| | | | | | | | | | | | | | | |
|---|---|---|---|---|---|---|---|---|---|---|---|---|---|---|
| sh | − | − | − | − | − | − | − | − | − | − | − | 0 | 0 | 0 |
| th | − | − | − | − | − | − | − | − | − | − | − | 0 | 0 | 0 |
| uh | 0 | − | − | − | − | − | − | − | − | − | + | + | + | − |
| zh | − | − | − | − | − | − | − | − | − | − | + | 0 | 0 | 0 |
| ah | 0 | − | − | − | − | − | − | − | − | − | + | − | − | − |
| ay | 0 | − | − | − | − | − | − | − | − | − | + | − | − | + |
| aw | 0 | − | − | − | − | − | − | − | − | − | + | − | + | + |
| b | − | − | − | − | − | − | − | − | − | − | + | 0 | 0 | 0 |
| dx | − | − | − | − | − | − | − | − | − | − | + | 0 | 0 | 0 |
| d | − | − | − | − | − | − | − | − | − | − | + | 0 | 0 | 0 |
| jh | − | − | − | − | − | − | − | − | − | − | + | 0 | 0 | 0 |
| ey | 0 | − | − | − | − | − | − | − | − | − | + | − | − | + |
| f | − | − | − | − | − | − | − | − | − | − | − | 0 | 0 | 0 |
| g | − | − | − | − | − | − | − | − | − | − | + | 0 | 0 | 0 |
| hh | − | + | − | − | − | − | − | − | − | − | − | 0 | 0 | 0 |
| iy | 0 | − | − | − | − | − | − | − | − | − | + | − | − | + |
| y | − | − | − | − | − | − | − | − | − | − | + | 0 | 0 | 0 |
| k | − | + | − | − | − | − | − | − | − | − | − | 0 | 0 | 0 |
| l | − | − | − | − | − | − | − | + | − | − | + | 0 | 0 | 0 |
| el | − | − | − | − | − | − | − | + | − | − | + | 0 | 0 | 0 |
| m | − | − | − | − | − | − | − | − | − | − | + | 0 | 0 | 0 |
| n | − | − | − | − | − | − | − | − | − | − | + | 0 | 0 | 0 |
| en | − | − | − | − | − | − | − | − | − | − | + | 0 | 0 | 0 |
| ow | 0 | − | − | − | − | − | − | − | − | − | + | + | + | + |
| ov | 0 | − | − | − | − | − | − | − | − | − | + | + | − | + |
| p | − | + | − | − | − | − | − | − | − | − | − | 0 | 0 | 0 |
| s | − | − | − | − | − | − | − | − | − | − | − | 0 | 0 | 0 |
| t | − | + | − | − | − | − | − | − | − | − | − | 0 | 0 | 0 |
| ch | − | − | − | − | − | − | − | − | − | − | − | 0 | 0 | 0 |
| uw | 0 | − | − | − | − | − | − | − | − | − | + | + | + | − |
| v | − | − | − | − | − | − | − | − | − | − | + | 0 | 0 | 0 |
| w | − | − | − | − | − | − | − | − | − | − | + | + | + | 0 |
| z | − | − | − | − | − | − | − | − | − | − | + | 0 | 0 | 0 |

substitution cost of 0 in the letter-phone cost table in Table 4 are arranged in a letter-phone correspondence table, as in Table 6.

TABLE 6

| Letter | Corresponding phones | | |
|---|---|---|---|
| a | ae | aa | ax |
| b | b | | |
| c | k | s | |
| d | d | | |
| e | eh | ey | |
| f | f | | |
| g | g | jh | f |
| h | hh | | |
| i | ih | iy | |
| j | jh | | |
| k | k | | |
| l | l | | |
| m | m | | |
| n | n | en | |
| o | ao | ow | aa |
| p | p | | |
| q | k | | |
| r | r | | |
| s | s | | |
| t | t | th | dh |
| u | uw | uh | ah |
| v | v | | |
| w | w | | |
| x | k | | |
| y | y | | |
| z | z | | |

A letter's features were determined to be the set-theoretic union of the activated phonetic features of the phones that correspond to that letter in the letter-phone correspondence table of Table 6. For example, according to Table 6, the letter c corresponds with the phones /s/ and /k/. Table 7 shows the activated features for the phones /s/ and /k/.

TABLE 7

| phone | obstruent | continuant | alveolar | velar | aspirated |
|---|---|---|---|---|---|
| s | + | + | + | − | − |
| k | + | − | − | + | + |

Table 8 shows the union of the activated features of /s/ and /k/ which are the letter features for the letter c.

TABLE 8

| letter | obstruent | continuant | alveolar | velar | aspirated |
|---|---|---|---|---|---|
| c | + | + | + | + | + |

In FIG. 7, each letter of coat, that is, c (702), o (704), a (706), and t (708), is looked up in the letter phone correspondence table in Table 6. The activated features for each letter's corresponding phones are unioned and listed in (710), (712), (714) and (716). (710) represents the letter features for c, which are the union of the phone features for /k/ and /s/, which are the phones that correspond with that letter according to the table in Table 6. (712) represents the letter features for o, which are the union of the phone features for /ao/, /ow/ and /aa/, which are the phones that correspond with that letter according to the table in Table 6. (714) represents the letter features for a, which are the union of the phone features for /ae/, /aa/ and /ax/ which are the phones that correspond with that letter according to the table in Table 6. (716) represents the letter features for t, which are the union of the phone features for /t/, /th/ and /dh/, which are the phones that correspond with that letter according to the table in Table 6.

The letter features for each letter are then converted to numbers by consulting the feature number table in Table 9.

TABLE 9

| Phone | Number | Phone | Number |
|---|---|---|---|
| Vocalic | 1 | Low 2 | 28 |
| Vowel | 2 | Bilabial | 29 |
| Sonorant | 3 | Labiodental | 30 |
| Obstruent | 4 | Dental | 31 |
| Flap | 5 | Alveolar | 32 |
| Continuant | 6 | Post-alveolar | 33 |
| Affricate | 7 | Retroflex | 34 |
| Nasal | 8 | Palatal | 35 |
| Approximant | 9 | Velar | 36 |
| Click | 10 | Uvular | 37 |
| Trill | 11 | Pharyngeal | 38 |
| Silence | 12 | Glottal | 39 |
| Front 1 | 13 | Epiglottal | 40 |
| Front 2 | 14 | Aspirated | 41 |
| Mid front 1 | 15 | Hyper- | 42 |
| Mid front 2 | 16 | aspirated | |
| Mid 1 | 17 | Closure | 43 |
| Mid 2 | 18 | Ejective | 44 |
| Back 1 | 19 | Implosive | 45 |
| Back 2 | 20 | Lablialized | 46 |
| High 1 | 21 | Lateral | 47 |
| High 2 | 22 | Nasalized | 48 |
| Mid high 1 | 23 | Rhotacized | 49 |
| Mid high 2 | 24 | Voiced | 50 |
| Mid low 1 | 25 | Round 1 | 51 |
| Mid low 2 | 26 | Round 2 | 52 |
| Low 1 | 27 | Long | 53 |

A constant that is 100 * the location number, where locations start at 0, is added to the feature number in order to distinguish the features associated with each letter. The modified feature numbers are loaded into a word sized storage buffer for Stream 3 (718).

A disadvantage of prior approaches to the orthography-phonetics conversion problem by neural networks has been the choice of too small a window of letters for the neural network to examine in order to select an output phone for the middle letter. FIG. 8, numeral 800, and FIG. 9, numeral 900, illustrate two contrasting methods of presenting data to the neural network. FIG. 8 depicts a seven-letter window, proposed previously in the art, surrounding the first orthographic o (802) in photography. The window is shaded gray, while the target letter o (802) is shown in a black box.

This window is not large enough to include the final orthographic y (804) in the word. The final y (804) is indeed the deciding factor for whether the word's first o (802) is converted to phonetic /ax/ as in photography or /ow/ as in photograph. A novel innovation introduced here is to allow a storage buffer to cover the entire length of the word, as depicted in FIG. 9, where the entire word is shaded gray and the target letter o (902) is once again shown in a black box. In this arrangement, all letters in photography are examined with knowledge of all the other letters present in the word. In the case of photography, the initial o (902) would know about the final y (904), allowing for the proper pronunciation to be generated.

Another advantage to including the whole word in a storage buffer is that this permits the neural network to learn the differences in letter-phone conversion at the beginning, middle and ends of words. For example, the letter e is often silent at the end of words, as in the boldface e in game, theme, rhyme, whereas the letter e is less often silent at other points in a word, as in the boldface e in Edward, metal, net. Examining the word as a whole in a storage buffer as described here, allows the neural network to capture such important pronunciation distinctions that are a function of where in a word a letter appears.

The neural network produces an output hypothesis vector based on its input vectors, Stream 2 and Stream 3 and the internal transfer functions used by the processing elements (PE's). The coefficients used in the transfer functions are varied during the training process to vary the output vector. The transfer functions and coefficients are collectively referred to as the weights of the neural network, and the weights are varied in the training process to vary the output vector produced by given input vectors. The weights are set to small random values initially. The context description serves as an input vector and is applied to the inputs of the neural network. The context description is processed according to the neural network weight values to produce an output vector, i.e., the associated phonetic representation. At the beginning of the training session, the associated phonetic representation is not meaningful since the neural network weights are random values. An error signal vector is generated in proportion to the distance between the associated phonetic representation and the assigned target phonetic representation, Stream 1.

In contrast to prior approaches, the error signal is not simply calculated to be the raw distance between the associated phonetic representation and the target phonetic representation, by for example using a Euclidean distance measure, shown in Equation 1.

$$E = \sum_k ((d_k - o_k)^2) \qquad \text{Equation 1}$$

Rather, the distance is a function of how close the associated phonetic representation is to the target phonetic representation in featural space. Closeness in featural space is assumed to be related to closeness in perceptual space if the phonetic representations were uttered.

FIG. 10, numeral 1000, contrasts the Euclidean distance error measure with the feature-based error measure. The target pronunciation is /raepihd/ (1002). Two potential associated pronunciations are shown: /raepaxd/ (1004) and /raepbd/ (1006). /raepaxd/ (1004) is perceptually very similar to the target pronunciation, whereas /raepbd/ (1006) is rather far, in addition to being virtually unpronounceable. By the Euclidean distance measure in Equation 1, both /raepaxd/ (1004) and /raepbd/ (1006) receive an error score of 2 with respect to the target pronunciation. The two identical scores obscure the perceptual difference between the two pronunciations.

In contrast, the feature-based error measure takes into consideration that /ih/ and /ax/ are perceptually very similar, and consequently weights the local error when /ax/ is hypothesized for /ih/. A scale of 0 for identity and 1 for maximum difference is established, and the various phone oppositions are given a score along this dimension. Table 10 provides a sample of feature-based error multipliers, or weights, that are used for American English.

TABLE 10

| target phone | neural network phone hypothesis | error multiplier |
|---|---|---|
| ax | ih | .1 |
| ih | ax | .1 |
| aa | ao | .3 |
| ao | aa | .3 |
| ow | ao | .5 |
| ao | ow | .5 |
| ae | aa | .5 |
| aa | ae | .5 |
| uw | ow | .7 |
| ow | uw | .7 |

TABLE 10-continued

| target phone | neural network phone hypothesis | error multiplier |
|---|---|---|
| iy | ey | .7 |
| ey | iy | .7 |

In Table 10, multipliers are the same whether the particular phones are part of the target or part of the hypothesis, but this does not have to be the case. Any combinations of target and hypothesis phones that are not in Table 10 are considered to have a multiplier of 1.

FIG. 11, numeral 1100, shows how the unweighted local error is computed for the /ih/ in /raepihd/. FIG. 12, numeral 1200, shows how the weighted error using the multipliers in Table 10 is computed. FIG. 12 shows how the error for /ax/ where /ih/ is expected is reduced by the multiplier, capturing the perceptual notion that this error is less egregious than hypothesizing /b/ for /ih/, whose error is unreduced.

After computation of the error signal, the weight values are then adjusted in a direction to reduce the error signal. This process is repeated a number of times for the associated pairs of context descriptions and assigned target phonetic representations. This process of adjusting the weights to bring the associated phonetic representation closer to the assigned target phonetic representation is the training of the neural network. This training uses the standard back propagation of errors method. Once the neural network is trained, the weight values possess the information necessary to convert the context description to an output vector similar in value to the assigned target phonetic representation. The preferred neural network implementation requires up to ten million presentations of the context description to its inputs and the following weight adjustments before the neural network is considered fully trained.

The neural network contains blocks with two kinds of activation functions, sigmoid and softmax, as are known in the art. The softmax activation function is shown in Equation 2.

$$y_k = \frac{e^{I_k}}{\sum_{l=1}^{N} e^{I_k}} \qquad \text{Equation 2}$$

Figure 13:
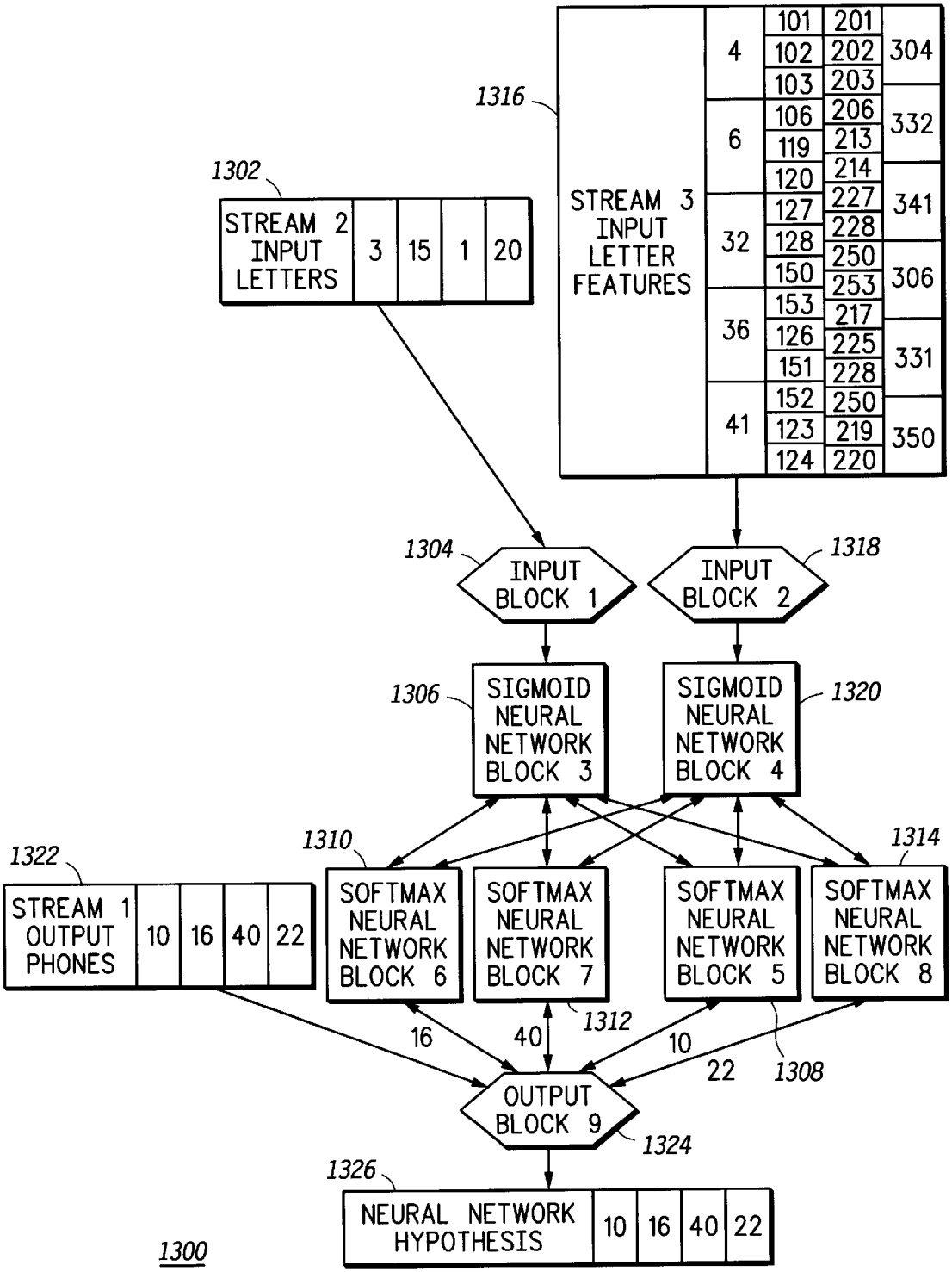
FIG. 13 is a schematic representation of the orthography-phonetics neural network architecture for training in accordance with the present invention.

FIG. 13, numeral 1300, illustrates the neural network architecture for training the orthography coat on the pronunciation /kowt/. Stream 2 (1302), the numeric encoding of the letters of the input orthography, encoded as shown in FIG. 4, is fed into input block 1 (1304). Input block 1 (1304) then passes this data onto sigmoid neural network block 3 (1306). Sigmoid neural network block 3 (1306) then passes the data for each letter into softmax neural network blocks 5 (1308), 6 (1310), 7 (1312) and 8 (1314).

Stream 3 (1316), the numeric encoding of the letter features of the input orthography, encoded as shown in FIG. 7, is fed into input block 2 (1318). Input block 2 (1318) then passes this data onto sigmoid neural network block 4 (1320). Sigmoid neural network block 4 (1320) then passes the data for each letter's features into softmax neural network blocks 5 (1308), 6 (1310), 7 (1312) and 8 (1314).

Stream 1 (1322), the numeric encoding of the target phones, encoded as shown in FIG. 4, is fed into output block 9 (1324).

Each of the softmax neural network blocks 5 (1308), 6 (1310), 7 (1312), and 8 (1314) outputs the most likely phone given the input information to output block 9 (1324). Output block 9 (1324) then outputs the data as the neural network hypothesis (1326). The neural network hypothesis is compared to Stream 1 (1322), the target phones, by means of the feature-based error function described above.

The error determined by the error function is then backpropagated to softmax neural network blocks 5 (1308), 6 (1310), 7 (1312) and 8 (1314), which in turn backpropagate the error to sigmoid neural network blocks 3 (1306) and 4 (1320).

The double arrows between neural network blocks in FIG. 13 indicate both the forward and backward movement through the network.

Figure 14:
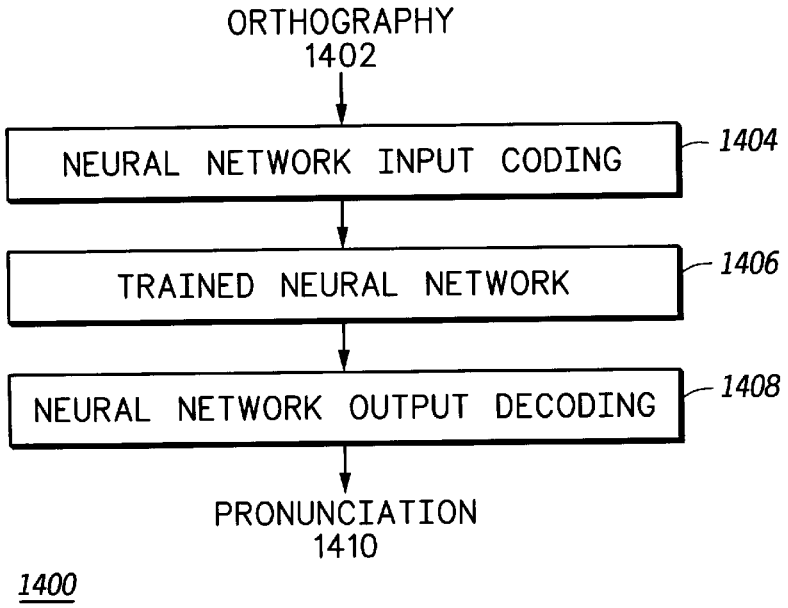
FIG. 14 is a schematic representation of the neural network orthography phonetics converter in accordance with the present invention.

FIG. 14, numeral 1400, shows the neural network orthography-pronunciation converter of FIG. 3, numeral 310, in detail. An orthography that is not found in the pronunciation lexicon (308), is coded into neural network input format (1404). The coded orthography is then submitted to the trained neural network (1406). This is called testing the neural network. The trained neural network outputs an encoded pronunciation, which must be decoded by the neural network output decoder (1408) into a pronunciation (1410).

Figure 15:
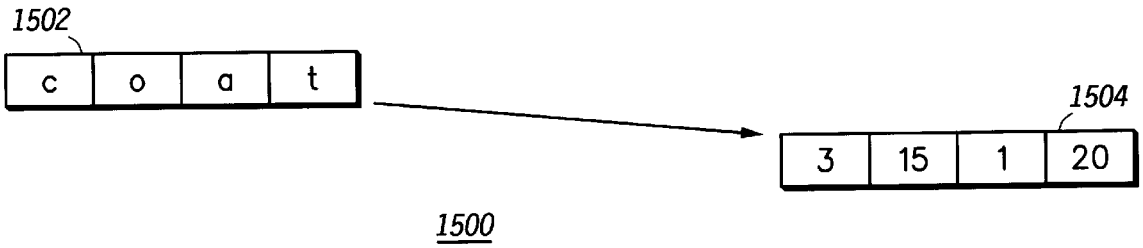
FIG. 15 is a schematic representation of the encoding of Stream 2 of FIG. 13 of the orthography-phonetics neural network for testing in accordance with the present invention.
Figure 16:
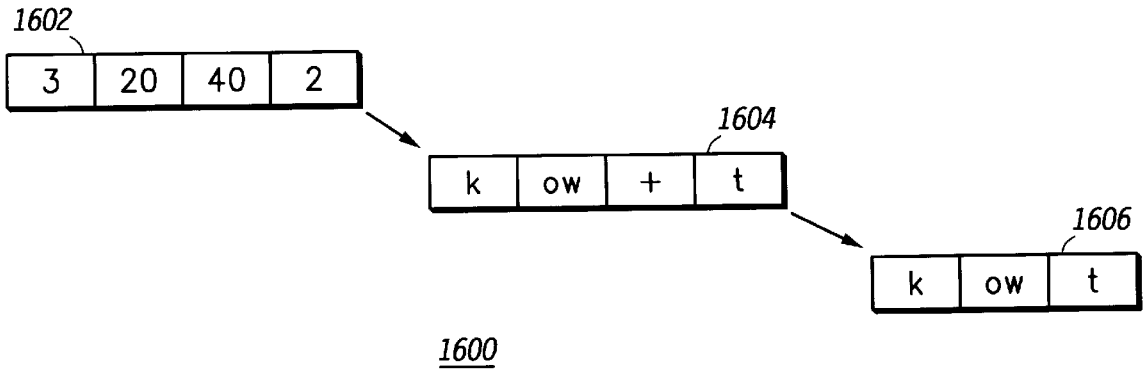
FIG. 16 is a schematic representation of the decoding of the neural network hypothesis into a phonetic representation in accordance with the present invention.

When the network is tested, only Stream 2 and Stream 3 need be encoded. The encoding of Stream 2 for testing is shown in FIG. 15, numeral 1500. Each letter is converted to a numeric code by consulting the letter table in Table 2. (1502) shows the letters of the word coat. (1504) shows the numeric codes for the letters of the word coat. Each letter's numeric code is then loaded into a word-sized storage buffer for Stream 2. Stream 3 is encoded as shown in FIG. 7. A word is tested by encoding Stream 2 and Stream 3 for that word and testing the neural network. The neural network returns a neural network hypothesis. The neural network hypothesis is then decoded, as shown in FIG. 16, by converting numbers (1602) to phones (1604) by consulting the phone number table in Table 3, and removing any alignment separators, which is number 40. The resulting string of phones (1606) can then serve as a pronunciation for the input orthography.

Figure 17:
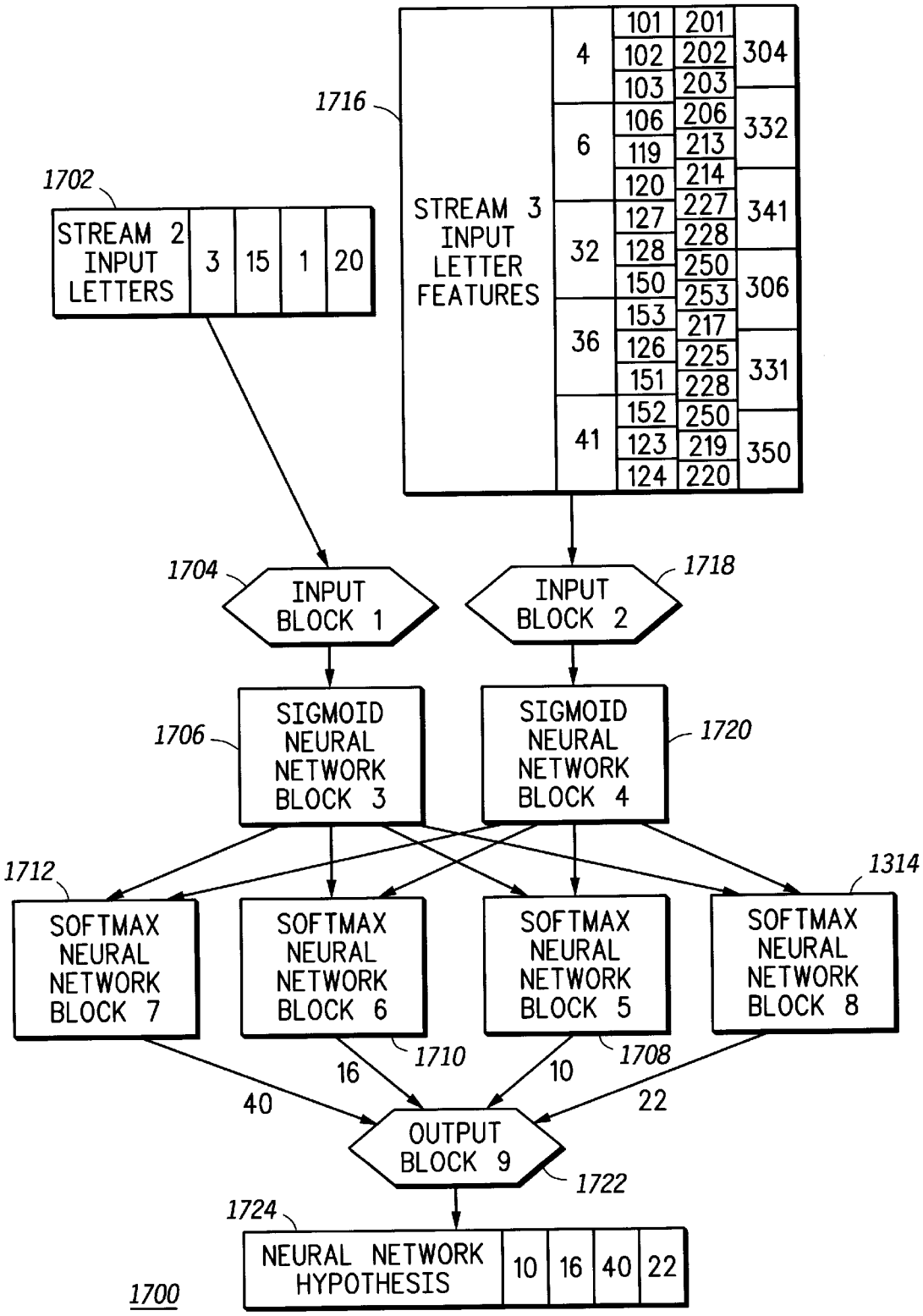
FIG. 17 is a schematic representation of the orthography-phonetics neural network architecture for testing in accordance with the present invention.

FIG. 17 shows how the streams encoded for the orthography coat fit into the neural network architecture. Stream 2 (1702), the numeric encoding of the letters of the input orthography, encoded as shown in FIG. 15, is fed into input block 1 (1704). Input block 1 (1704) then passes this data onto sigmoid neural network block 3 (1706). Sigmoid neural network block 3 (1706) then passes the data for each letter into softmax neural network blocks 5 (1708), 6 (1710), 7 (1712) and 8 (1714).

Stream 3 (1716), the numeric encoding of the letter features of the input orthography, encoded as shown in FIG. 7, is fed into input block 2 (1718). Input block 2 (1718) then passes this data onto sigmoid neural network block 4 (1720). Sigmoid neural network block 4 (1720) then passes the data for each letter's features into softmax neural network blocks 5 (1708), 6 (1710), 7 (1712) and 8 (1714).

Each of the softmax neural network blocks 5 (1708), 6 (1710), 7 (1712), and 8 (1714) outputs the most likely phone given the input information to output block 9 (1722). Output block 9 (1722) then outputs the data as the neural network hypothesis (1724).

Figure 18:
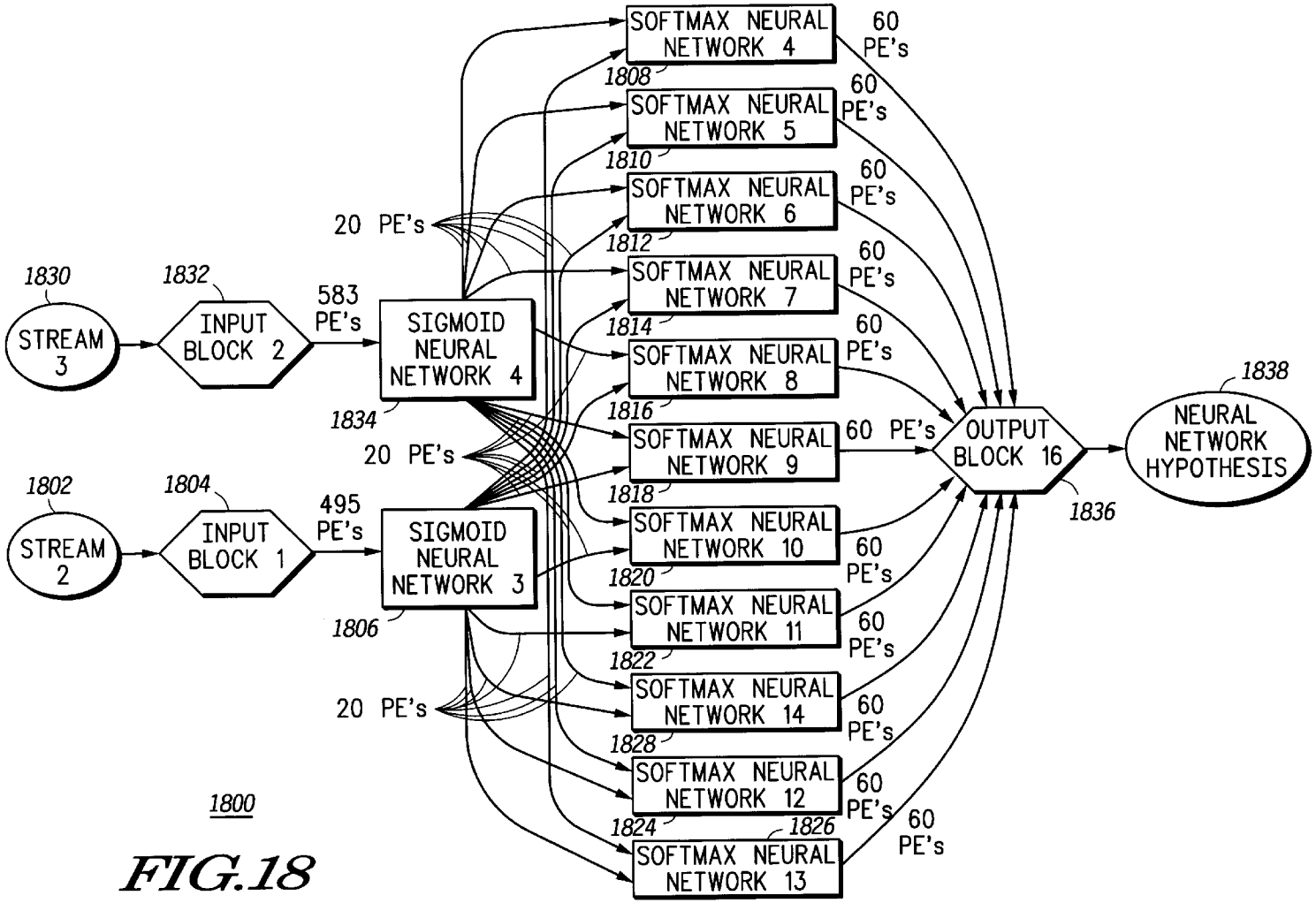
FIG. 18 is a schematic representation of the orthography-phonetics neural network for testing on an eleven-letter orthography in accordance with the present invention.

FIG. 18, numeral 1800, presents a picture of the neural network for testing organized to handle an orthographic word of 11 characters. This is just an example; the network could be organized for an arbitrary number of letters per word. Input stream 2 (1802), containing a numeric encoding of letters, encoded as shown in FIG. 15, loads its data into input block 1 (1804). Input block 1 (1804) contains 495 PE's, which is the size required for an 11 letter word, where each letter could be one of 45 distinct characters. Input block 1 (1804) passes these 495 PE's to sigmoid neural network 3 (1806).

Sigmoid neural network 3 (1806) distributes a total of 220 PE's equally in chunks of 20 PE's to softmax neural networks 4 (1808), 5 (1810), 6 (1812), 7 (1814), 8 (1816), 9 (1818), 10 (1820), 11 (1822), 12 (1824) and 13 (1826) and 14 (1828).

Input stream 3 (1830), containing a numeric encoding of letter features, encoded as shown in FIG. 7, loads its data into input block 2 (1832). Input block 2 (1832) contains 583 processing elements which is the size required for an 11 letter word, where each letter is represented by up to 53 activated features. Input block 2 (1832) passes these 583 PE's to sigmoid neural network 4 (1834).

Sigmoid neural network 4 (1834) distributes a total of 220 PE's equally in chunks of 20 PE's to softmax neural networks 4 (1808), 5 (1810), 6 (1812), 7 (1814), 8 (1816), 9 (1818), 10 (1820), 11 (1822), 12 (1824) and 13 (1826) and 14 (1828).

Softmax neural networks 4–14 each pass 60 PE's for a total of 660 PE's to output block 16 (1836). Output block 16 (1836) then outputs the neural network hypothesis (1838).

Figure 19:
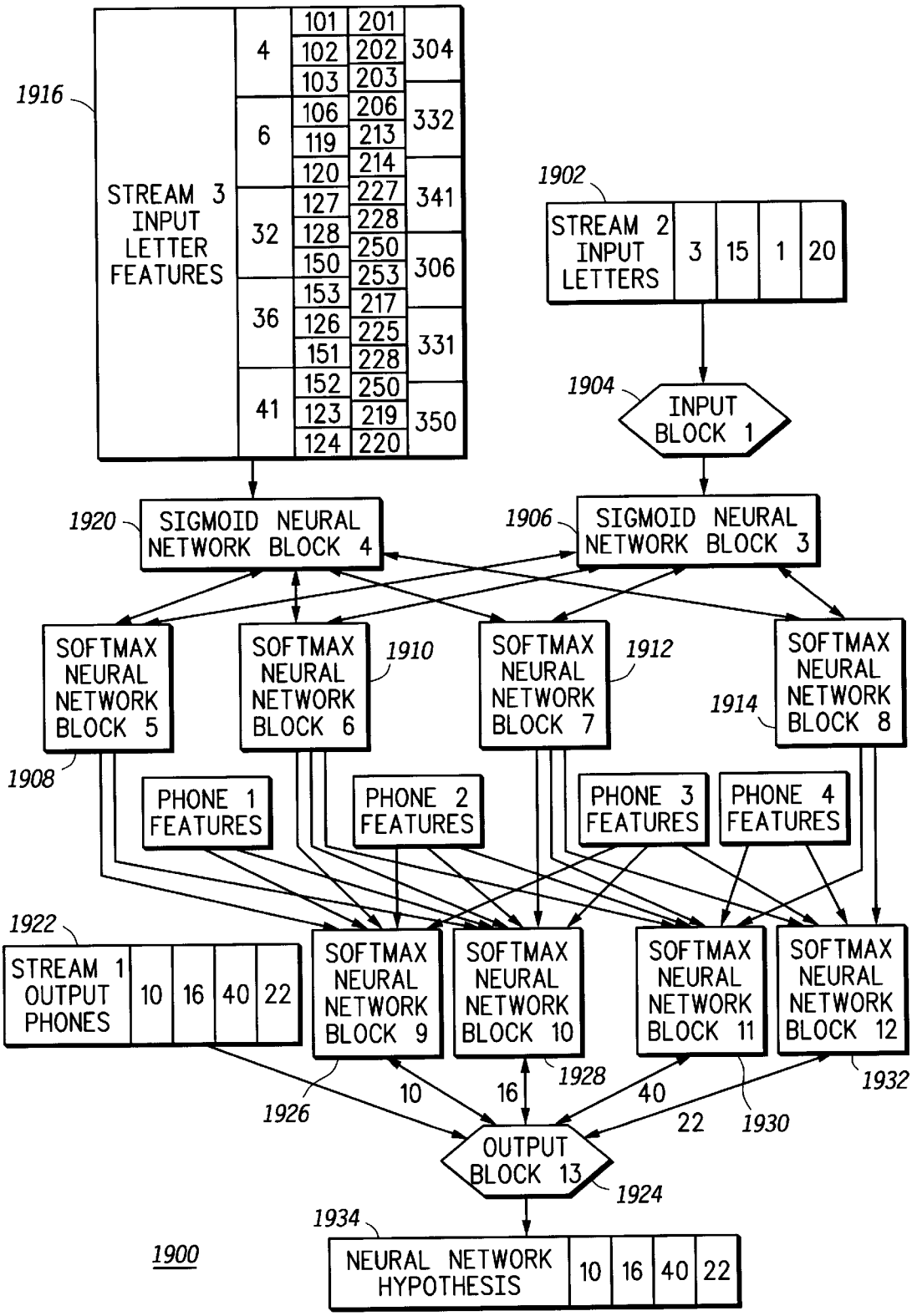
FIG. 19 is a schematic representation of the orthography-phonetics neural network with a double phone buffer in accordance with the present invention.

Another architecture described under the present invention involves two layers of softmax neural network blocks, as shown in FIG. 19, numeral 1900. The extra layer provides for more contextual information to be used by the neural network in order to determine phones from orthography. In addition, the extra layer takes additional input of phone features, which adds to the richness of the input representation, thus improving the network's performance.

FIG. 19 illustrates the neural network architecture for training the orthography coat on the pronunciation /kowt/. Stream 2 (1902), the numeric encoding of the letters of the input orthography, encoded as shown in FIG. 15, is fed into input block 1 (1904). Input block 1 (1904) then passes this data onto sigmoid neural network block 3 (1906). Sigmoid neural network block 3 (1906) then passes the data for each letter into softmax neural network blocks 5 (1908), 6 (1910), 7 (1912) and 8 (1914).

Stream 3 (1916), the numeric encoding of the letter features of the input orthography, encoded as shown in FIG. 7, is fed into input block 2 (1918). Input block 2 (1918) then passes this data onto sigmoid neural network block 4 (1920). Sigmoid neural network block 4 (1920) then passes the data for each letter's features into softmax neural network blocks 5 (1908), 6 (1910), 7 (1912) and 8 (1914).

Stream 1 (1922), the numeric encoding of the target phones, encoded as shown in FIG. 4, is fed into output block 13 (1924).

Each of the softmax neural network blocks 5 (1908), 6 (1910), 7 (1912), and 8 (1914) outputs the most likely phone given the input information, along with any possible left and right phones to softmax neural network blocks 9 (1926), 10 (1928), 11 (1930) and 12 (1932). For example, blocks 5 (1908) and 6 (1910) pass the neural network's hypothesis for phone 1 to block 9 (1926), blocks 5 (1908), 6 (1910), and 7 (1912) pass the neural network's hypothesis for phone 2 to block 10 (1928), blocks 6 (1910), 7 (1912), and 8 (1914) pass the neural network's hypothesis for phone 3 to block 11 (1930), and blocks 7 (1912) and 8 (1914) pass the neural network's hypothesis for phone 4 to block 12 (1932).

In addition, the features associated with each phone according to the table in Table 5 are passed to each of blocks 9 (1926), 10 (1928), 11 (1930), and 12 (1932) in the same way. For example, features for phone 1 and phone 2 are passed to block 9 (1926), features for phone 1, 2 and 3 are passed to block 10 (1928), features for phones 2, 3, and 4 are passed to block 11 (1930), and features for phones 3 and 4 are passed to block 12 (1932).

Blocks 9 (1926), 10 (1928), 11 (1930) and 12 (1932) output the most likely phone given the input information to output block 13 (1924). Output block 13 (1924) then outputs the data as the neural network hypothesis (1934). The neural network hypothesis (1934) is compared to Stream 1 (1922), the target phones, by means of the feature-based error function described above.

The error determined by the error function is then backpropagated to softmax neural network blocks 5 (1908), 6 (1910), 7 (1912) and 8 (1914), which in turn backpropagate the error to sigmoid neural network blocks 3 (1906) and 4 (1920).

The double arrows between neural network blocks in FIG. 19 indicate both the forward and backward movement through the network.

One of the benefits of the neural network letter-to-sound conversion method described here is a method for compressing pronunciation dictionaries. When used in conjunction with a neural network letter-to-sound converter as described here, pronunciations do not need to be stored for any words in a pronunciation network for which the neural network can correctly discover the pronunciation. Neural networks overcome the large storage requirements of phonetic representations in dictionaries since the knowledge base is stored in weights rather than in memory.

Table 11 shows an excerpt of the pronunciation lexicon excerpt shown in Table 1.

TABLE 11

| Orthography | Pronunciation |
|---|---|
| cat | |
| dog | |
| school | |
| coat | |

This lexicon excerpt does not need to store any pronunciation information, since the neural network was able to hypothesize pronunciations for the orthographies stored there correctly. This results in a savings of 21 bytes out of 41 bytes, including ending 0 bytes, or a savings of 51% in storage space.

The approach to orthography-pronunciation conversion described here has an advantage over rule-based systems in that it is easily adaptable to any language. For each language, all that is required is that an orthography-pronunciation lexicon in that language, and a letter-phone cost table in that language. It may also be necessary to use characters from the International Phonetic Alphabet, so the full range of phonetic variation in the world's languages is possible to model.

As shown in FIG. 20, numeral 2000, the present invention implements a method for providing, in response to orthographic information, efficient generation of a phonetic representation, including the steps of: inputting (2002) an orthography of a word and a predetermined set of input letter features, utilizing (2004) a neural network that has been trained using automatic letter phone alignment and predetermined letter features to provide a neural network hypothesis of a word pronunciation.

In the preferred embodiment, the predetermined letter features for a letter represent a union of features of predetermined phones representing the letter.

As shown in FIG. 21, numeral 2100, the pretrained neural network (2004) has been trained using the steps of: providing (2102) a predetermined number of letters of an associated orthography consisting of letters for the word and a phonetic representation consisting of phones for a target pronunciation of the associated orthography, aligning (2104) the associated orthography and phonetic representation using a dynamic programming alignment enhanced with a featurally-based substitution cost function, providing (2106) acoustic and articulatory information corresponding to the letters, based on a union of features of predetermined phones representing each letter, providing (2108) a predetermined amount of context information; and training (2110) the neural network to associate the input orthography with a phonetic representation.

In a preferred embodiment, the predetermined number of letters (2102) is equivalent to the number of letters in the word.

Figure 24:
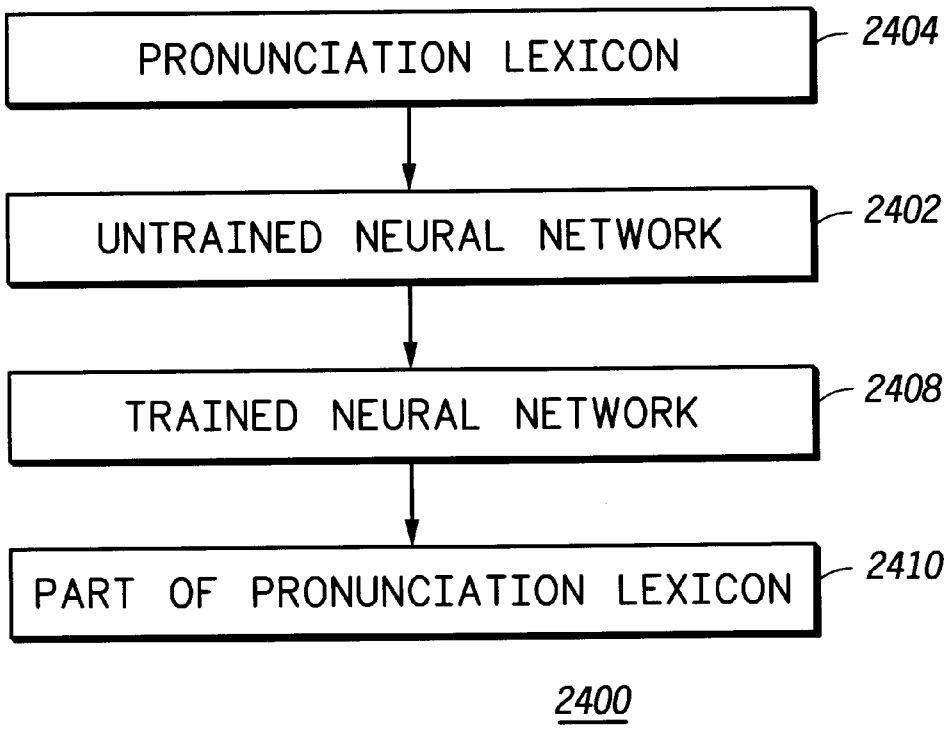
FIG. 24 is a schematic representation of the training of a neural network to hypothesize pronunciations from a lexicon that will no longer need to be stored in the lexicon due to the neural network in accordance with the present invention.

As shown in FIG. 24, numeral 2400, an orthography-pronunciation lexicon (2404) is used to train an untrained neural network (2402), resulting in a trained neural network (2408). The trained neural network (2408) produces word pronunciation hypotheses (2004) which match part of an orthography-pronunciation lexicon (2410). In this way, the orthography-pronunciation lexicon (306) of a text to speech system (300) is reduced in size by using neural network word pronunciation hypotheses (2004) in place of the pronunciation transcriptions in the lexicon for that part of orthography-pronunciation lexicon which is matched by the neural network word pronunciation hypotheses.

Training (2110) the neural network may further include providing (2112) a predetermined number of layers of output reprocessing in which phones, neighboring phones, phone features and neighboring phone features are passed to succeeding layers.

Training (2110) the neural network may further include employing (2114) a feature-based error function, for example as calculated in FIG. 12, to characterize the distance between target and hypothesized pronunciations during training.

The neural network (2004) may be a feed-forward neural network.

The neural network (2004) may use backpropagation of errors.

The neural network (2004) may have a recurrent input structure.

The predetermined letter features (2002) may include articulatory or acoustic features.

The predetermined letter features (2002) may include a geometry of acoustic or articulatory features as is known in the art.

The automatic letter phone alignment (2004) may be based on consonant and vowel locations in the orthography and associated phonetic representation.

The predetermined number of letters of the orthography and the phones for the pronunciation of the orthography (2102) may be contained in a sliding window.

The orthography and pronunciation (2102) may be described using feature vectors.

The featurally-based substitution cost function (2104) uses predetermined substitution, insertion and deletion costs and a predetermined substitution table.

Figure 22:
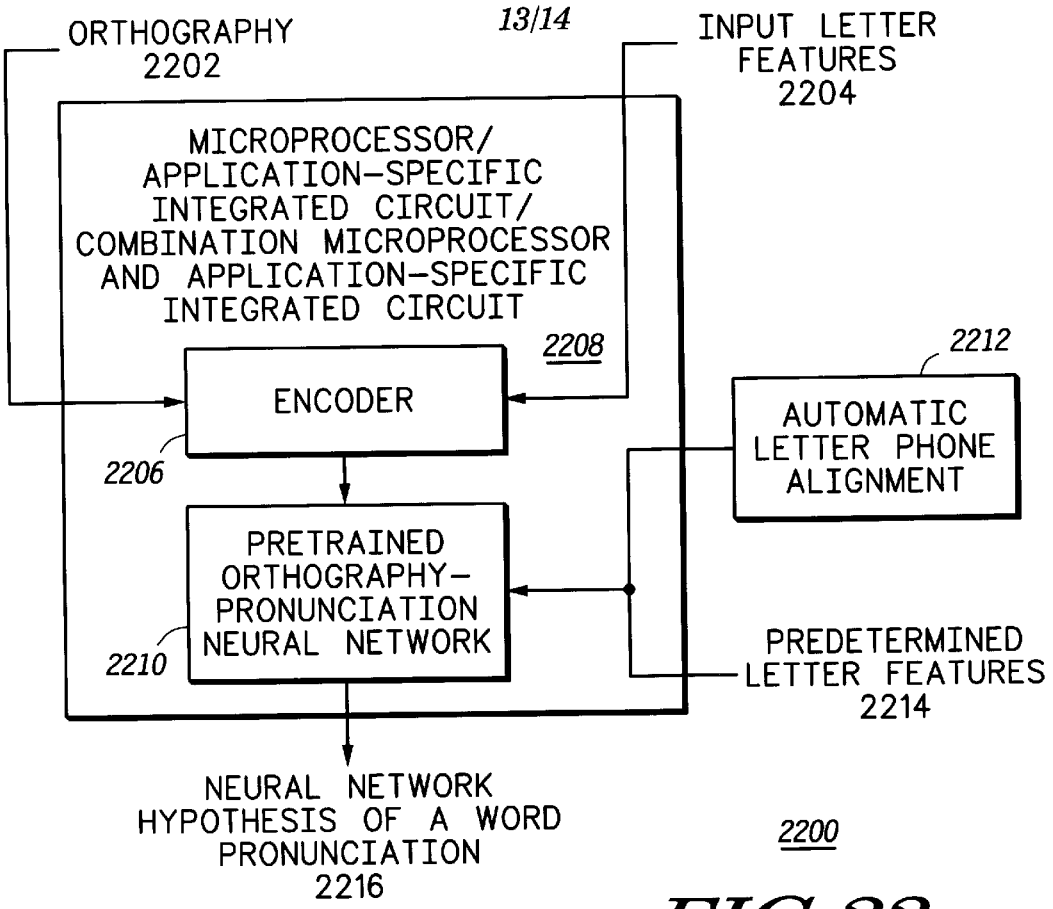
FIG. 22 is a schematic representation of a microprocessor/application-specific integrated circuit/combination microprocessor and application-specific integrated circuit for the transformation of orthography into pronunciation by neural network in accordance with the present invention.

As shown in FIG. 22, numeral 2200, the present invention implements a device (2208), including at least one of a microprocessor, an application specific integrated circuit, and a combination of a microprocessor and an application specific integrated circuit, for providing, in response to orthographic information, efficient generation of a phonetic representation, including an encoder (2206), coupled to receive an orthography of a word (2202) and a predetermined set of input letter features (2204), for providing digital input to a pretrained orthography-pronunciation neural network (2210), wherein the pretrained orthography-pronunciation neural network (2210) has been trained using automatic letter phone alignment (2212) and predetermined letter features (2214). The pretrained orthography-pronunciation neural network (2210), coupled to the encoder (2206), provides a neural network hypothesis of a word pronunciation (2216).

In a preferred embodiment, the pretrained orthography-pronunciation neural network (2210) is trained using feature-based error backpropagation, for example as calculated in FIG. 12.

In a preferred embodiment, the predetermined letter features for a letter represent a union of features of predetermined phones representing the letter.

As shown in FIG. 21, numeral 2100, the pretrained orthography-pronunciation neural network (2210) of the microprocessor/ASIC/combination microprocessor and ASIC (2208) has been trained in accordance with the following scheme: providing (2102) a predetermined number of letters of an associated orthography consisting of letters for the word and a phonetic representation consisting of phones for a target pronunciation of the associated orthography; aligning (2104) the associated orthography and phonetic representation using a dynamic programming alignment enhanced with a featurally-based substitution cost function; providing (2106) acoustic and articulatory information corresponding to the letters, based on a union of features of predetermined phones representing each letter; providing (2108) a predetermined amount of context information; and training (2110) the neural network to associate the input orthography with a phonetic representation.

In a preferred embodiment, the predetermined number of letters (2102) is equivalent to the number of letters in the word.

As shown in FIG. 24, numeral 2400, an orthography-pronunciation lexicon (2404) is used to train an untrained neural network (2402), resulting in a trained neural network (2408). The trained neural network (2408) produces word pronunciation hypotheses (2216) which match part of an orthography-pronunciation lexicon (2410). In this way, the orthography-pronunciation lexicon (306) of a text to speech system (300) is reduced in size by using neural network word pronunciation hypotheses (2216) in place of the pronunciation transcriptions in the lexicon for that part of orthography-pronunciation lexicon which is matched by the neural network word pronunciation hypotheses.

Training the neural network (2110) may further include providing (2112) a predetermined number of layers of output reprocessing in which phones, neighboring phones, phone features and neighboring phone features are passed to succeeding layers.

Training the neural network (2110) may further include employing (2114) a feature-based error function, for example as calculated in FIG. 12, to characterize the distance between target and hypothesized pronunciations during training.

The pretrained orthography pronunciation neural network (2210) may be a feed-forward neural network.

The pretrained orthography pronunciation neural network (2210) may use backpropagation of errors.

The pretrained orthography pronunciation neural network (2210) may have a recurrent input structure.

The predetermined letter features (2214) may include acoustic or articulatory features.

The predetermined letter features (2214) may include a geometry of acoustic or articulatory features as is known in the art.

The automatic letter phone alignment (2212) may be based on consonant and vowel locations in the orthography and associated phonetic representation.

The predetermined number of letters of the orthography and the phones for the pronunciation of the orthography (2102) may be contained in a sliding window.

The orthography and pronunciation (2102) may be described using feature vectors.

The featurally-based substitution cost function (2104) uses predetermined substitution, insertion and deletion costs and a predetermined substitution table.

Figure 23:
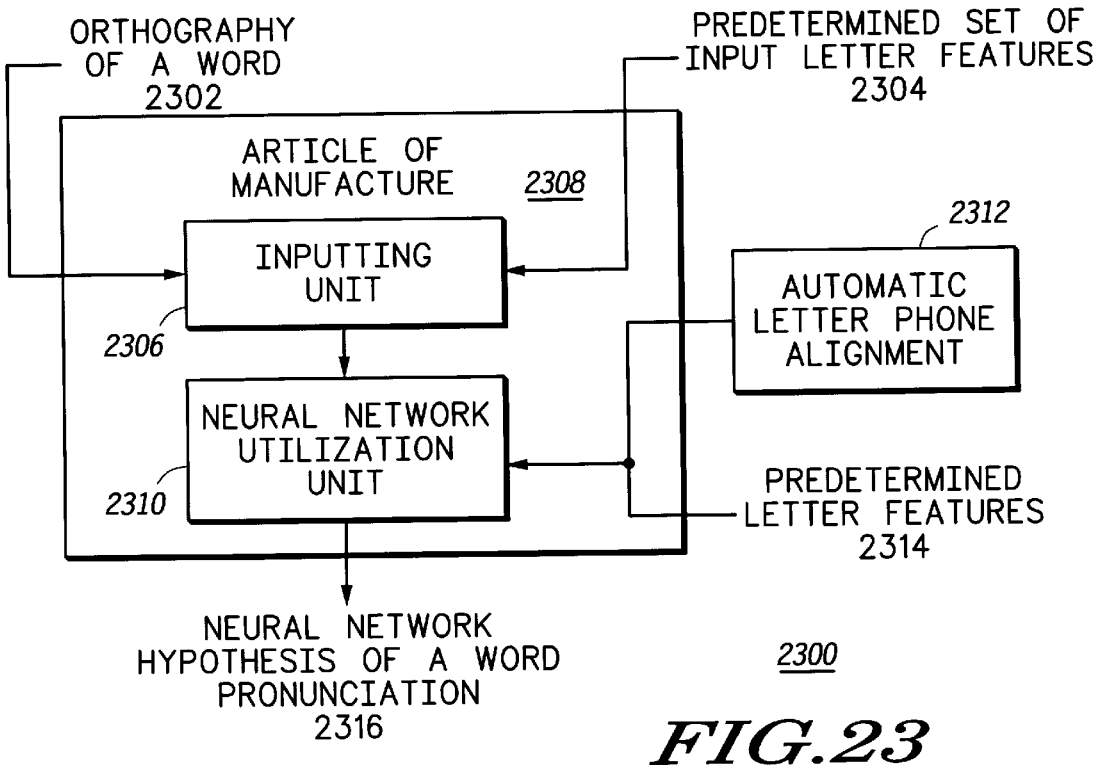
FIG. 23 is a schematic representation of an article of manufacture for the transformation of orthography into pronunciation by neural network in accordance with the present invention.

As shown in FIG. 23, numeral 2300, the present invention implements an article of manufacture (2308), e.g., software, that includes a computer usable medium having computer readable program code thereon. The computer readable code includes an inputting unit (2306) for inputting an orthography of a word (2302) and a predetermined set of input letter features (2304) and code for a neural network utilization unit (2310) that has been trained using automatic letter phone alignment (2312) and predetermined letter features (2314) to provide a neural network hypothesis of a word pronunciation (2316).

In a preferred embodiment, the predetermined letter features for a letter represent a union of features of predetermined phones representing the letter.

As shown in FIG. 21, typically the pretrained neural network has been trained in accordance with the following scheme: providing (2102) a predetermined number of letters of an associated orthography consisting of letters for the word and a phonetic representation consisting of phones for a target pronunciation of the associated orthography; aligning (2104) the associated orthography and phonetic representation using a dynamic programming alignment enhanced with a featurally-based substitution cost function; providing (2106) acoustic and articulatory information corresponding to the letters, based on a union of features of predetermined phones representing each letter; providing (2108) a predetermined amount of context information; and training (2110) the neural network to associate the input orthography with a phonetic representation.

In a preferred embodiment, the predetermined number of letters (2102) is equivalent to the number of letters in the word.

As shown in FIG. 24, numeral 2400, an orthography-pronunciation lexicon (2404) is used to train an untrained neural network (2402), resulting in a trained neural network (2408). The trained neural network (2408) produces word pronunciation hypotheses (2316) which match part of an orthography-pronunciation lexicon (2410). In this way, the orthography-pronunciation lexicon (306) of a text to speech system (300) is reduced in size by using neural network word pronunciation hypotheses (2316) in place of the pronunciation transcriptions in the lexicon for that part of orthography-pronunciation lexicon which is matched by the neural network word pronunciation hypotheses.

The article of manufacture may be selected to further include providing (2112) a predetermined number of layers of output reprocessing in which phones, neighboring phones, phone features and neighboring phone features are passed to succeeding layers. Also, the invention may further include, during training, employing (2114) a feature-based error function, for example as calculated in FIG. 12, to characterize the distance between target and hypothesized pronunciations during training.

In a preferred embodiment, the neural network utilization unit (2310) may be a feed-forward neural network.

In a preferred embodiment, the neural network utilization unit (2310) may use backpropagation of errors.

In a preferred embodiment, the neural network utilization unit (2310) may have a recurrent input structure.

The predetermined letter features (2314) may include acoustic or articulatory features.

The predetermined letter features (2314) may include a geometry of acoustic or articulatory features as is known in the art.

The automatic letter phone alignment (2312) may be based on consonant and vowel locations in the orthography and associated phonetic representation.

The predetermined number of letters of the orthography and the phones for the pronunciation of the orthography (2102) may be contained in a sliding window.

The orthography and pronunciation (2102) may be described using feature vectors.

The featurally-based substitution cost function (2104) uses predetermined substitution, insertion and deletion costs and a predetermined substitution table.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A method for providing, in response to orthographic information, efficient generation of a phonetic representation, comprising the steps of:

a) inputting an orthography of a word and a predetermined set of input letter features;

b) utilizing a neural network that has been trained using automatic letter phone alignment and predetermined letter features to provide a neural network hypothesis of a word pronunciation.

2. The method of claim 1 wherein the predetermined letter features for a letter represent a union of features of predetermined phones representing the letter.

3. The method of claim 1 wherein the pretrained neural network has been trained using the steps of:

a) providing a predetermined number of letters of an associated orthography consisting of letters for the word and a phonetic representation consisting of phones for a target pronunciation of the associated orthography;

b) aligning the associated orthography and phonetic representation using a dynamic programming alignment enhanced with a featurally-based substitution cost function;

c) providing acoustic and articulatory information corresponding to the letters, based on a union of features of predetermined phones representing each letter;

d) providing a predetermined amount of context information; and e) training the neural network to associate the input orthography with a phonetic representation.

4. The method of claim 3, step (a), wherein the predetermined number of letters is equivalent to the number of letters in the word.

5. The method of claim 1 where a pronunciation lexicon is reduced in size by using neural network word pronunciation hypotheses which match target pronunciations.

6. The method of claim 3 further including providing a predetermined number of layers of output reprocessing in which phones, neighboring phones, phone features and neighboring phone features are passed to succeeding layers.

7. The method of claim 3 further including, during training, employing a feature-based error function to characterize a distance between target and hypothesized pronunciations during training.

8. The method of claim 1, step (b) wherein the neural network is a feed-forward neural network.

9. The method of claim 1, step (b) wherein the neural network uses backpropagation of errors.

10. The method of claim 1, step (b) wherein the neural network has a recurrent input structure.

11. The method of claim 1, wherein the predetermined letter features include articulatory features.

12. The method of claim 1, wherein the predetermined letter features include acoustic features.

13. The method of claim 1, wherein the predetermined letter features include a geometry of articulatory features.

14. The method of claim 1, wherein the predetermined letter features include a geometry of acoustic features.

15. The method of claim 1, step (b), wherein the automatic letter phone alignment is based on consonant and vowel locations in the orthography and associated phonetic representation.

16. The method of claim 3, step (a), wherein the letters and phones are contained in a sliding window.

17. The method of claim 1, wherein the orthography is described using a feature vector.

18. The method of claim 1, wherein the pronunciation is described using a feature vector.

19. The method of claim 6, wherein the number of layers of output reprocessing is 2.

20. The method of claim 3, step (b), where the featurally-based substitution cost function uses predetermined substitution, insertion and deletion costs and a predetermined substitution table.

21. A device for providing, in response to orthographic information, efficient generation of a phonetic representation, comprising:

a) an encoder, coupled to receive an orthography of a word and a predetermined set of input letter features, for providing digital input to a pretrained orthography-pronunciation neural network, wherein the pretrained neural network has been trained using automatic letter phone alignment and predetermined letter features;

b) the pretrained orthography-pronunciation neural network, coupled to the encoder, for providing a neural network hypothesis of a word pronunciation.

22. The device of claim 21 wherein the pretrained neural network is trained using feature-based error backpropagation.

23. The device of claim 21 wherein the predetermined letter features for a letter represent a union of features of predetermined phones representing the letter.

24. The device of claim 21 wherein the device includes at least one of:

a) a microprocessor;

b) application specific integrated circuit; and c) a combination of a) and b).

25. The device of claim 21 wherein the pretrained neural network has been trained in accordance with the following scheme:

a) providing a predetermined number of letters of an associated orthography consisting of letters for the word and a phonetic representation consisting of phones for a target pronunciation of the associated orthography;

b) aligning the associated orthography and phonetic representation using a dynamic programming alignment enhanced with a featurally-based substitution cost function;

c) providing acoustic and articulatory information corresponding to the letters, based on a union of features of predetermined phones representing each letter;

d) providing a predetermined amount of context information; and e) training the neural network to associate the input orthography with a phonetic representation.

26. The device of claim 25, step (a) wherein the predetermined number of letters is equivalent to the number of letters in the word.

27. The device of claim 21, where a pronunciation lexicon is reduced in size by using neural network word pronunciation hypotheses which match target pronunciations.

28. The device of claim 21 further including providing a predetermined number of layers of output reprocessing in which phones, neighboring phones, phone features and neighboring phone features are passed to succeeding layers.

29. The device of claim 21 further including, during training, employing a feature-based error function to characterize the distance between target and hypothesized pronunciations during training.

30. The device of claim 21, wherein the neural network is a feed-forward neural network.

31. The device of claim 21, wherein the neural network uses backpropagation of errors.

32. The device of claim 21, wherein the neural network has a recurrent input structure.

33. The device of claim 21, wherein the predetermined letter features include articulatory features.

34. The device of claim 21, wherein the predetermined letter features include acoustic features.

35. The device of claim 21, wherein the predetermined letter features include a geometry of articulatory features.

36. The device of claim 21, wherein the predetermined letter features include a geometry of acoustic features.

37. The device of claim 21, step (b), wherein the automatic letter phone alignment is based on consonant and vowel locations in the orthography and associated phonetic representation.

38. The device of claim 25, step (a), wherein the letters and phones are contained in a sliding window.

39. The device of claim 21, wherein the orthography is described using a feature vector.

40. The device of claim 21, wherein the pronunciation is described using a feature vector.

41. The device of claim 28, wherein the number of layers of output reprocessing is 2.

42. The device of claim 25, step (b), where the featurally-based substitution cost function uses predetermined substitution, insertion and deletion costs and a predetermined substitution table.

43. An article of manufacture for converting orthographies into phonetic representations, comprising a computer usable medium having computer readable program code means thereon comprising:

a) inputting means for inputting an orthography of a word and a predetermined set of input letter features;

b) neural network utilization means for utilizing a neural network that has been trained using automatic letter phone alignment and predetermined letter features to provide a neural network hypothesis of a word pronunciation.

44. The article of manufacture of claim 43 wherein the predetermined letter features for a letter represent a union of features of predetermined phones representing the letter.

45. The article of manufacture of claim 43 wherein the pretrained neural network has been trained in accordance with the following scheme:

a) providing a predetermined number of letters of an associated orthography consisting of letters for the word and a phonetic representation consisting of phones for a target pronunciation of the associated orthography;

b) aligning the associated orthography and phonetic representation using a dynamic programming alignment enhanced with a featurally-based substitution cost function;

c) providing acoustic and articulatory information corresponding to the letters, based on a union of features of predetermined phones representing each letter;

d) providing a predetermined amount of context information; and e) training the neural network to associate the input orthography with a phonetic representation.

46. The article of manufacture of claim 45, step (a), wherein the predetermined number of letters is equivalent to the number of letters in the word.

47. The article of manufacture of claim 43 where a pronunciation lexicon is reduced in size by using neural network word pronunciation hypotheses which match target pronunciations.

48. The article of manufacture of claim 43 further including providing a predetermined number of layers of output reprocessing in which phones, neighboring phones, phone features and neighboring phone features are passed to succeeding layers.

49. The article of manufacture of claim 43 further including, during training, employing a feature-based error function to characterize the distance between target and hypothesized pronunciations during training.

50. The article of manufacture of claim 43, wherein the neural network is a feed-forward neural network.

51. The article of manufacture of claim 43, wherein the neural network uses backpropagation of errors.

52. The article of manufacture of claim 43, wherein the neural network has a recurrent input structure.

53. The article of manufacture of claim 43, wherein the predetermined letter features include articulatory features.

54. The article of manufacture of claim 43, wherein the predetermined letter features include acoustic features.

55. The article of manufacture of claim 43, wherein the predetermined letter features include a geometry of articulatory features.

56. The article of manufacture of claim 43, step (b), wherein the automatic letter phone alignment is based on consonant and vowel locations in the orthography and associated phonetic representation.

57. The article of manufacture of claim 45, step (a), wherein the letters and phones are contained in a sliding window.

58. The article of manufacture of claim 43, wherein the orthography is described using a feature vector.

59. The article of manufacture of claim 43, wherein the pronunciation is described using a feature vector.

60. The article of manufacture of claim 47, wherein the number of layers of output reprocessing is 2.

61. The article of manufacture of claim 45, step (b), where the featurally-based substitution cost function uses predetermined substitution, insertion and deletion costs and a predetermined substitution table.

* * * * *